US008716585B2

(12) United States Patent
Ludwig

(10) Patent No.: US 8,716,585 B2
(45) Date of Patent: May 6, 2014

(54) CUSTOMIZABLE ELECTRONIC MUSICAL INSTRUMENT AND USER INTERFACE

(71) Applicant: Lester F. Ludwig, San Antonio, TX (US)

(72) Inventor: Lester F. Ludwig, San Antonio, TX (US)

(73) Assignee: Lester F. Ludwig, San Antonio, TX (US)

( * ) Notice: Subject to any disclaimer, the term of this patent is extended or adjusted under 35 U.S.C. 154(b) by 0 days.

(21) Appl. No.: 13/662,403

(22) Filed: Oct. 26, 2012

(65) Prior Publication Data

US 2013/0047824 A1 Feb. 28, 2013

Related U.S. Application Data

(63) Continuation of application No. 12/786,438, filed on May 25, 2010, now Pat. No. 8,309,835, which is a continuation of application No. 10/737,043, filed on Dec. 15, 2003, now Pat. No. 7,732,702.

(51) Int. Cl.
*G10H 1/32* (2006.01)

(52) U.S. Cl.
USPC ..... 84/644; 84/670; 84/718; 84/719

(58) Field of Classification Search
USPC ..... 84/615, 644, 653, 670, 718, 721, 746, 84/719
See application file for complete search history.

(56) References Cited

U.S. PATENT DOCUMENTS

| | | | | | |
|---|---|---|---|---|---|
| 3,551,580 | A * | 12/1970 | Glenn et al. | 84/723 |
| 5,063,821 | A * | 11/1991 | Battle | 84/723 |
| 5,140,889 | A * | 8/1992 | Segan et al. | 84/723 |
| 5,182,416 | A * | 1/1993 | Schweizer | 84/723 |
| 5,315,910 | A * | 5/1994 | Soupios | 84/453 |
| 5,520,292 | A * | 5/1996 | Lombardi | 211/85.6 |
| 5,929,355 | A * | 7/1999 | Adinolfi | 84/421 |
| 6,075,197 | A * | 6/2000 | Chan | 84/730 |
| 6,369,313 | B2 * | 4/2002 | Devecka | 84/743 |
| 6,610,916 | B1 * | 8/2003 | Torrez | 84/421 |
| 7,692,090 | B2 * | 4/2010 | Negoescu et al. | 84/718 |
| 2002/0005108 | A1 * | 1/2002 | Ludwig | 84/600 |
| 2002/0005111 | A1 * | 1/2002 | Ludwig | 84/645 |
| 2003/0188622 | A1 * | 10/2003 | Wilson | 84/267 |
| 2003/0221545 | A1 * | 12/2003 | Tomoda | 84/723 |
| 2004/0069130 | A1 * | 4/2004 | Liu et al. | 84/723 |
| 2004/0206226 | A1 * | 10/2004 | Negoescu et al. | 84/600 |
| 2010/0147139 | A1 * | 6/2010 | Negoescu et al. | 84/743 |

* cited by examiner

*Primary Examiner* — David S. Warren
(74) *Attorney, Agent, or Firm* — Procopio, Cory, Hargreaves & Savitch LLP

(57) ABSTRACT

A customizable electronic musical instrument comprising a mounting frame for securing a plurality of user-installable electronic musical modules of various types including a type for generating at least one real-time control signal responsive to user operation, a type for generating audio signals, responsive to a real-time control signal, and a for processing audio signals responsive to at least one of a real-time control signal. The instrument can transmit electrical signals to an external system and can include internal sound amplification. The instrument can include one or more of a keyboard, touchpad, strumpad, impact sensor, slider control, expression wheel, joystick, ribbon controller, button, switch, pressure sensor, multiple-position selector, knob potentiometer, and music synthesizer elements. Signals may be routed among modules by a switch or bus.

20 Claims, 35 Drawing Sheets

LIGHTING AND SPECIAL EFFECT SIGNALS guitar, etc.

pipa sitar violin/oud koto/sheng biwa ruan/konun'go /wolgum vina/escalloped dulcimer

CUSTOMIZABLE ELECTRONIC MUSICAL INSTRUMENT AND USER INTERFACE

CROSS-REFERENCE TO RELATED APPLICATIONS

This application is a continuation of U.S. Ser. No. 12/786,438, filed on May 25, 2010, now U.S. Pat. No. 8,309,835, which is a continuation of U.S. Ser. No. 10/737,043 filed on Dec. 15, 2003, now U.S. Pat. No. 7,732,702, issued on Jun. 8, 2010.

BACKGROUND OF THE INVENTION

This present invention relates generally to musical instruments, and in particular to the design, application, and use of modular structures in creating customized and aggregated musical instruments. Currently, customization of musical instruments has been a specialized, limited, and expensive affair, and the formation of particular aggregations of musical instruments into a common "aggregated" musical instrument has not yet been perfected.

SUMMARY OF THE INVENTION

An assortment of field-customizable, mainstream and exotic electronic musical instruments will be presented, with a particular focus on providing extensive support for the easy and robust creation of a broad range of aggregated instruments. Some embodiments provide extensive functional customization of instruments within the mainstream accepted instrument modalities, as well as opening a wide range of completely new instrument modalities. The invention further facilitates entirely new manufacturing, marketing, and sales paradigms permitting a broad range of open industry development and commerce, thus making an individual musician's creation of new exotic instrument arrangements an economically viable sector for both mass manufacturing and the niche cottage industry. New opportunities are provided for the creation of multiple-vendor standardizations, multiple-vendor manufacturing, multiple-vendor competitive features. This will provide the music equipment user and music industry as a whole, access to an extensive range of instrument customization, diversification, and education.

BRIEF DESCRIPTION OF THE DRAWINGS

The above and other aspects, features and advantages of the present invention will become more apparent upon consideration of the following description of preferred embodiments taken in conjunction with the accompanying drawing figures, wherein.

DETAILED DESCRIPTION OF THE PREFERRED EMBODIMENTS

In the following descriptions, reference is made to the accompanying drawing figures which form a part hereof, and which show by way of illustration specific embodiments of the invention. It will be understood by those of ordinary skill in this technological field that other embodiments may be utilized, and structural, electrical, as well as procedural changes may be made without departing from the scope of the present invention.

Furthermore, in the figures, it is to be understood that a significant emphasis has been placed on depicting functionality, structure, and methods regarding many aspects of the invention. In choosing this emphasis, little treatment of aesthetics and visual appeal has been included. It is to be understood that a plethora of additional techniques of encasement, overlay bezel, alternate structure, ornamental embellishment, etc. may be used to obtain a wide range of aesthetic value and effect.

1. Formalized Modularity, Aggregation, and Customization Structures for Electric and Electronic Music Instruments Over the years, musical instruments have evolved in a number of isolated and interacting ways. Although very complex and subject to rigorous debate, in broad terms a particular kind of instrument, such as a violin, keyboard, flute, reed, brass, drum, etc., would evolve within a conceptual and contextual framework defining that instrument or variations of it. For example, a harpsichord, virginal, bentside, clavichord, etc, versus the group of pipe organ, portative organ, etc., versus the group of fortepiano, pianoforte, etc., versus the group of celleste, carillon, etc. In some instances, one type of instrument would borrow technology developments and enhancements perfected within another, but essentially key defining elements comprising the 'canon' or formal 'institution' of a specific instrument would largely remain invariant over time. As presented herein, these types of instruments will be referred to as "traditional instruments."

Figure 1A:
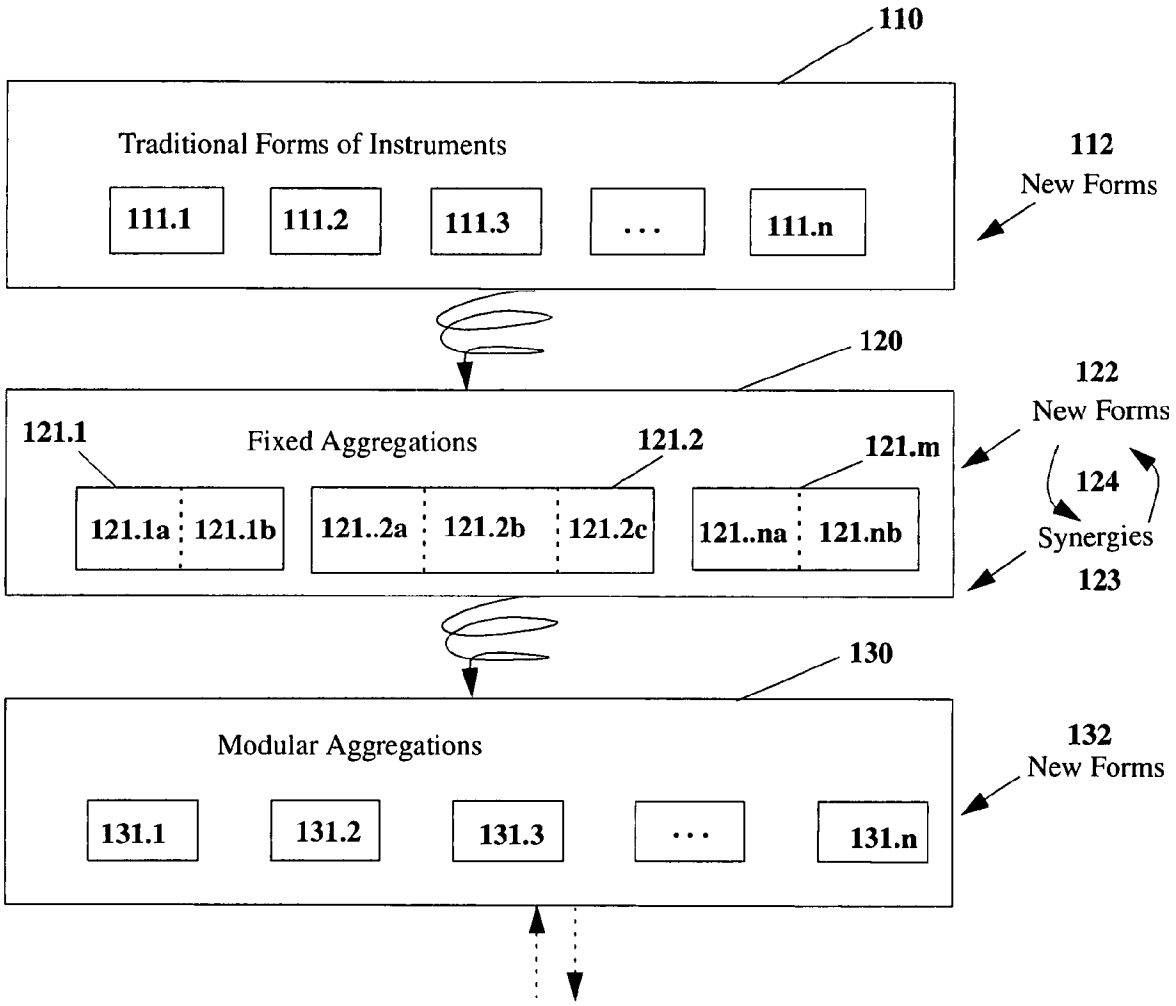
FIGS. 1*a*-1*c* depict the relationship among traditional instruments, aggregated instruments, customization, hierarchies of modularity, and applications as they relate to the invention.

Every so often a new instrument, perhaps an entirely new type of instrument, would be introduced and over time itself become considered a traditional instrument. Similarly, some established traditional instruments may fall out of favor or be replaced, eventually becoming 'period instruments,' such as the recorder or rebec, 'ancient instruments,' such as the Greek Lyre or Chinese Bone Flutes, or in fact 'lost instruments,' such as the "lira da braccio" used by Italian court poet-musicians in the Renaissance. Referring to FIG. 1*a*, element 110 provides a representation of this process that will serve as a basis for subsequent discussion.

In the case of traditional instruments, variations on the same instrument have sometimes been combined to create a larger "aggregate" instrument. Long-standing examples are the multiple keyboards found in harpsichords and organs, and later, the trap drum set. More recent examples are the multi-necked guitars such as the classic ESD 1275 Gibson double neck (first available in 1958, Gibson Guitar Corporation, Nashville, Tenn.) or the more contemporary Roberts Rotoneck guitar (see for example U.S. Pat. Nos. 4,981,063 and D311,750 by Roberts—more recent versions include the Roto-Caster™ which secures the rotating neck on one end to a traditional guitar-body; Roberts Rotoneck, Brea, Calif.). In some cases the component instruments within an aggregate instrument share some of the same internal components (for example, multiple keyboards of harpsichords and organs may share the same instrument housing and "stops") and in 'other cases effectively do so in a very limited manner (for example, shared supporting arrangements in trap drums and multi-necked guitars). Additionally, some of the component instruments are specifically laid out to permit playing of two or more of the components simultaneously (for example, harpsichords, organs, and trap drums) while others (such as multi-necked guitars) are not (at least in original intent)

Referring to FIG. 1*a*, element 120 represents the class of fixed aggregate instruments and related processes. There are new forms of instruments 122, here driven by synergies 123 among component instruments of the aggregations; for example, new stops or mechanisms shared within a pipe organ, or new percussion elements or mechanisms (such as foot pedals) within the trap drum set. Successful synergies will give rise to new forms in the recurring cycle 124 as shown. Due to manufacturing practices and market forces, however, many if not most of the possibilities illustrated by these exemplary instruments may have limited markets and high cost, and may require difficult decisions as to which functional elements are selected and how to physically position them.

The present invention addresses these issues by targeting, for example, the creation of an open evolvable family and architecture of modular instrument components. Each such module may, for example, be a functionally self-contained instrument, controller, signal processor, interface, sound production module, or novelty module. Various types of mounting frames can be provided for facilitating the physical aggregation of these modules. The mounting frames can further be enhanced to provide additional supporting infrastructure for signal routing, power distribution, control distribution, interface consolidation, etc. Each of the modules may utilize one or more predefined signal, control, and power interfaces. The family of modular instrument components and mounting frames can be designed for simple consumer manipulation, allowing aggregate instruments and controllers to be easily assembled and reconfigured by end users. Referring still to FIG. 1*a*, element 130 abstracts this class of instruments and related processes.

Figure 1B:
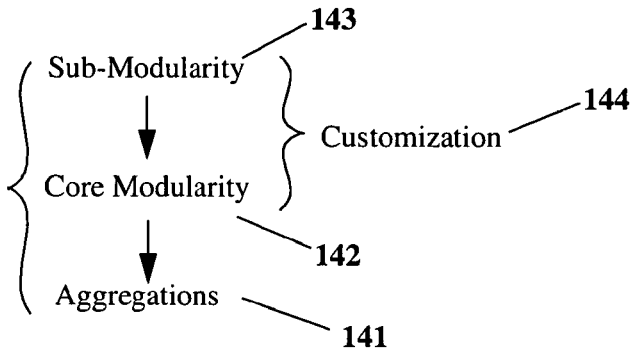

With these ideas established, the above notion of 'aggregations' 120,130 may then be adapted to extend the applicability of this group of ideas. Referring to FIG. 1*b*, traditional instruments may be thought of as providing base-points of a 'core modularity' 142 that may be used to create aggregated instruments 141, and the constituent parts of these traditional instruments (such as necks, vibration-sensing transducers, controller, signal processing, interface, or sound production units) may be regarded as component modules which provide a level of sub-modularity 143.

The creation of traditional instruments from modularized components, i.e. 'customization' 144, has been informally with us in the form of a few coexisting de facto standards (for example, modularized components such as guitar pickups, bridges, tuning heads, tail pieces) for some time but has nearly universally required the expertise of specialists.

Leveraging, differentiating, abstracting, and reorganizing these ideas and observations, the invention provides for, among other things, for some or all of the following aspects:

1. Modular sub-components providing a layer of sub-modularity 143;
2. Modular components providing a layer of core modularity 142, which may be built from the sub-components within the sub-modularity layer 143 or, alternatively, may be stand-alone entities; and
3. Aggregations 141 of modular components 142.

Aspects 1 and 2 together lead to musical instruments that can easily be customized, creating entirely new forms of value to the user and entirely new manufacturing, sales, and marketing opportunities. The market segment and principle user value of these aspects is rooted within familiar traditional musical instruments, driven by motivations of largely taste-defined personalization.

Aspects 2 and 3 together enable users to easily create aggregate instruments with an extensive degree of customization capability. This creates yet other entirely new form of user value and new manufacturing, sales, and marketing opportunities. The market segment and value to the user of these aspects lies in aggregating familiar traditional musical instruments to create new and exciting aggregations of functionality with rich cooperative or synergistic possibilities.

It is noted that this exemplary three-layer model depicted in FIG. 1*b* can be expanded in either or both directions of sub-modularizing and aggregation. To date the "fixed" type of aggregated instruments 120 have been a limited and specialized, low-volume segment of the marketplace. Some modular multiple neck instruments have been proposed over the years (for example, attachable/detachable second-neck retrofit units shown in U.S. Pat. Nos. 4,240,319 and 5,315,910 by Soupious, and the modular multiple neck instruments shown in U.S. Pat. No. 3,130,625 by Savona and U.S. Pat. No. 4,785,705 by Patterson). Similarly, modular replaceable pickups (see for example U.S. Pat. No. 6,043,422 by Chapman, Modular Electric Guitars, Mounds View, Minn.; Mercurio Guitars Inc., Chanhassen, Minn.; and Rick Dodge Convertible Guitars, Tallahassee, Fla.) and other components (see for example U.S. Pat. No. 4,201,108 by Bunker) have been available for some time, but are also a niche market of tiny scale. Why would it be desirable for the music manufacturing and sales industries to embrace the modular aggregated instruments 130,141 discussed abstractly so far? To answer, a few illustrative examples are considered.

Figure 1C:
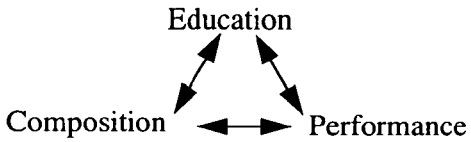
Figure 2A:
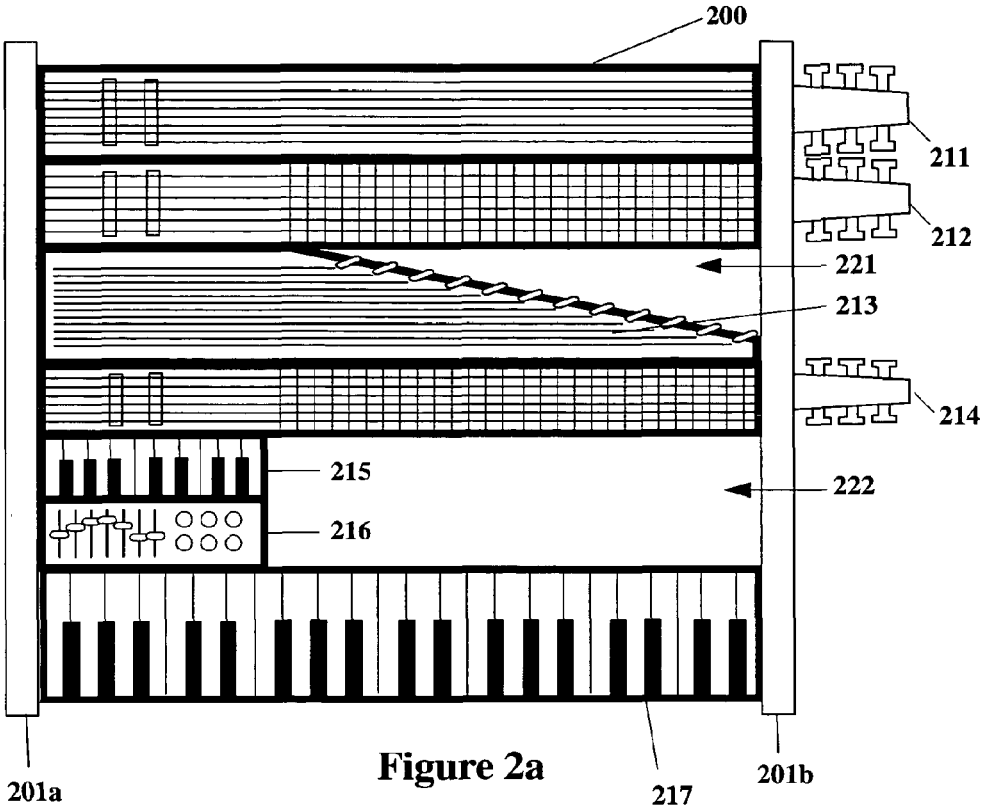
FIGS. 2*a*-2*b* show two exemplary aggregated instruments.
Figure 2B:
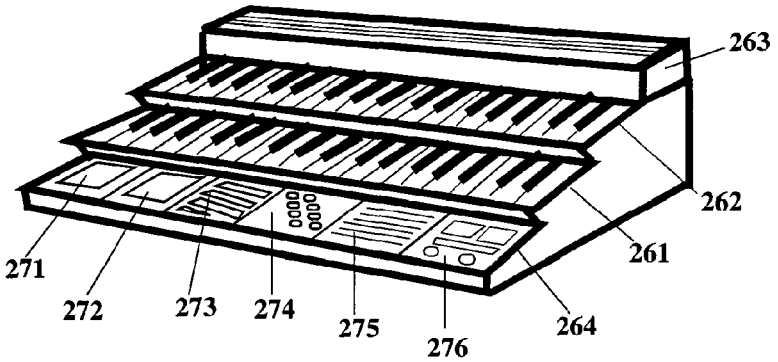

Setting FIG. 1*c* aside for the moment, FIGS. 2*a*-2*b* show two exemplary aggregated instruments. These examples are somewhat larger in scope for discussion purposes, illustrating perhaps an approximate natural expansion limits of the depicted configurations. FIG. 2*a* depicts a shoulder-worn instrument 200 which emphasizes electronic stringed component modules 211-214 and purely electronic controllers 215-217 (including keyboards 215, 217 of various sizes), all held in an effectively planar configuration by lightweight securing frame elements 201*a*, 201*b*. Such a configuration may support intricate details required of one or more pieces, or be advantageous in a compositional environment. Two fretted guitar-like modules 212, 214 are provided. These may be identical, or differ in the types of strings or pickups used, the number of strings used, the inter-string spacing used, or in the inclusion of various specialty aspects such as, for example, different types of frets (guitar, sitar, pipa, etc.), different types of bridges (fixed guitar bridge, vibrato guitar bridge, modulated string tension guitar bridge, sitar bridge, piezo pickup bridge, etc.), or other differentiating aspects.

Open unfretted stringed module 211 may be a modest group of bass strings, as used in an archlute or Gibson "Harp Guitar™", a bank of sympathetic strings, an adapted harp, etc. They are positioned here to be played with the thumb while playing fretted instrument module 212, but could also by intent or circumstance be plucked in isolation. Similarly, open unfretted stringed module 213 may comprise a larger number of bass strings, a bank of sympathetic strings; an adapted harp, etc., positioned here to be played with the thump while playing fretted instrument module 214, but could also by intent or circumstance be plucked in isolation. A small-format keyboard 215 may be used as a "proximate keyboard" as described in U.S. Pat. No. 6,570,078, and is here shown supplemented with an additional electronic controller 216. An additional electronic controller 216 is depicted here comprising sliders (controlling perhaps volume and timbre) and fingertip-actuated impact sensors for responsively triggering electronic percussion modules, but could additionally or alternatively comprise one or more strumpads, touchpads, switches, buttons, etc. as described in U.S. Pat. No. 6,570,078, for example. A full-sized keyboard 217 could be used for conventional keyboard playing and soloing with one or both hands.

Either or both fretted stringed instrument modules 212, 214 could be played with one hand (using one-handed tapping techniques), perhaps facilitated by either or both of 212, 214 being instrument modules of a touch variety (such as that described in U.S. Pat. No. 2,989,884 by Bunker, and U.S. Pat. No. 4,142,436 by Chapman, and other touch-style stringed instruments, typically with damped open strings). It is also noted that open stringed instrument modules 211, 213 can readily be played with one hand. The aggregate instrument 200 may be readily configured to support playing modules 211 and 212 simultaneously with one hand, perhaps also including some or all of 213; similarly modules 213 and 214 may be played simultaneously with one hand, perhaps also including 215 and perhaps 216; similarly modules 214 and 215 may be played simultaneously with one hand, perhaps also including 216; and similarly modules 215 and 216 may be played simultaneously with one hand. Also note the exemplary arrangement 200 also includes gaps 221, 222 for traditional under-neck hand access to fretted necks of fretted stringed instrument modules 212, 214, respectively.

FIG. 2*b* depicts another layout format for an aggregate instrument emphasizing electronic keyboards 261,262 and other electronic controllers 271-276 but also including an electronic stringed component module 263 that may be played by extending the arms—the latter may be, for example, of a touch variety (such as that disclosed in U.S. Pat. No. 2,989,884 by Bunker, or U.S. Pat. No. 4,142,436 by Chapman, or other touch-style stringed instruments, typically with damped open strings), an unfretted adapted harp, a non-uniformly fretted dulcimer format, etc.

Figure 3A:
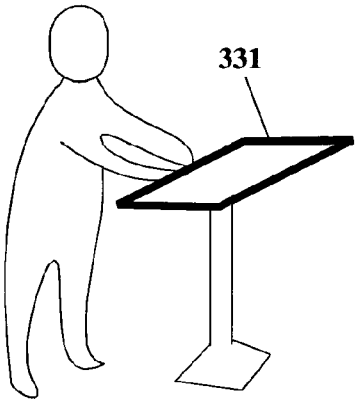
FIGS. 3*a*-3*e* depict a number of supporting and playing arrangements for aggregated instruments including the use of floor stands, straps and open access areas.
Figure 3B:
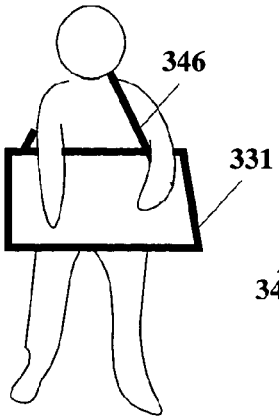

This arrangement comprises a lightweight supporting frame facilitating a staggered arrangement with an exemplary profile such as that shown in FIG. 6. The resulting arrangement may be played in an essentially-horizontal position as suggested by FIG. 3*a*, here involving an essentially-horizontal-supporting floor stand, or in an essentially-vertical position as suggested by FIG. 3*b* supported by a flexible shoulder strap, or as shown by FIG. 3*d* supported by an essentially-vertical supporting floor stand. The keyboards 261, 262 may be collocated in a "proximate keyboard" arrangement (examples of which are disclosed in U.S. Pat. No. 6,570,078) or with conventional forms of two-keyboard separation. The various electronic controllers 271-276 may include various smaller sized sub-modules, each comprising, for example, one or more sliders, fingertip-actuated impact sensors, strumpads, touchpads, switches, buttons, etc. as illustrated in U.S. Pat. No. 6,570,078. The invention further provides for these exemplary smaller-sized sub-modules to indeed not be purely electronic but include vibrating elements such as small string arrays, mbira tynes, etc., examples of which are also shown in U.S. Pat. No. 6,570,078.

Figure 3C:
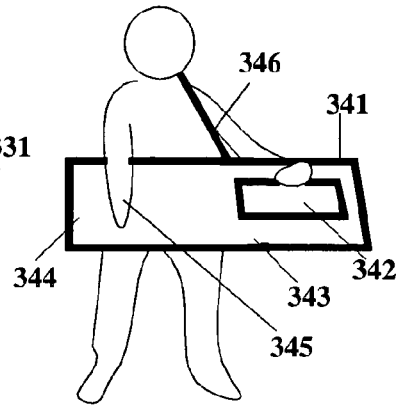
Figure 3D:
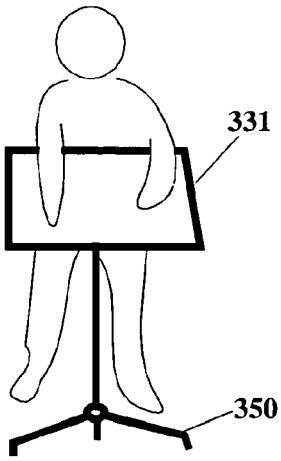
Figure 3E:
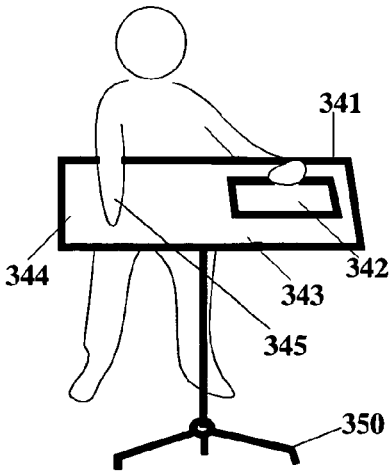

An additional example that combines various functional and ergonomic aspects of the previous two examples is the shoulder strap-supported configuration generally depicted by FIG. 3*c*. Here, a fretted instrument module 341 is shown with traditional under-neck access made possible by an open gap 342. At the bottom of the arrangement is an area 343 naturally suited for one or more keyboards as it is readily and naturally reachable by a comfortably extended arm 345. The region 344, opposing the gap 342, may be a blank area or comprise any number of smaller modules as described above. Alternatively, the configuration may be essentially-vertically supported without the flexible shoulder strap used in FIG. 3*c* by an essentially-vertical supporting floor stand, as shown in FIG. 3*e*.

It is further noted that the invention provides for any of the configurations shown in FIG. 2*a* and FIGS. 3*a*-3*e* to be such that the mounting frames secure the instrument modules in a coplanar configuration, in a staircase configuration, or perhaps in a curved configuration. For example, the essentially coplanar arrangement depicted frontally in FIG. 2*a* could also be mounted on a staircase mounting frame, as depicted in FIG. 6, or on a curved frame of some sort; the resulting arrangement could then be worn with a flexible shoulder strap, as depicted in FIG. 3*c*, set on a seated musician's leg, or vertically supported by a floor stand as in FIG. 3*e*. The staircase or curved mounting configuration could make those instrument modules farther from the musician's eyes advantageously easier to see or easier to play in specific ergonomic contexts. Similarly a staircase keyboard-based configuration, such as those depicted in FIG. 2*b* or FIG. 19, could be worn with a flexible shoulder strap as shown in FIG. 3*c*. Further, an aggregation of controller modules that are functionally equivalent to control panels may usefully be mounted in a coplanar, curved, or staircase configuration, creating a larger control panel that could be operated in any of the configurations of FIGS. 3*a*-3*e*.

Figure 4A:
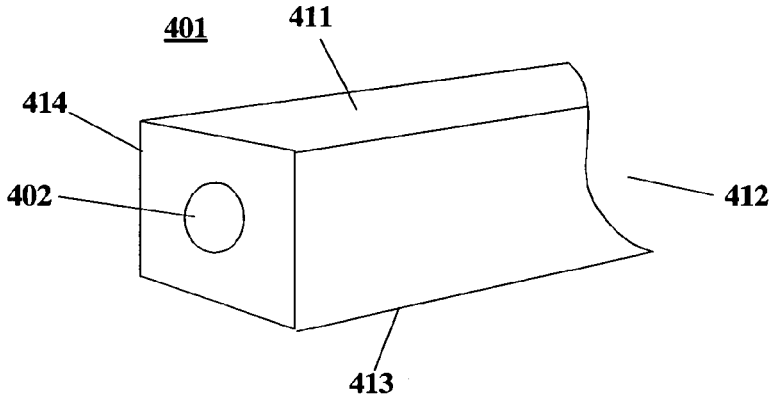
FIGS. 4*a*-4*c* depict two exemplary rotating arrangements for securing instrument modules.
Figure 4B:
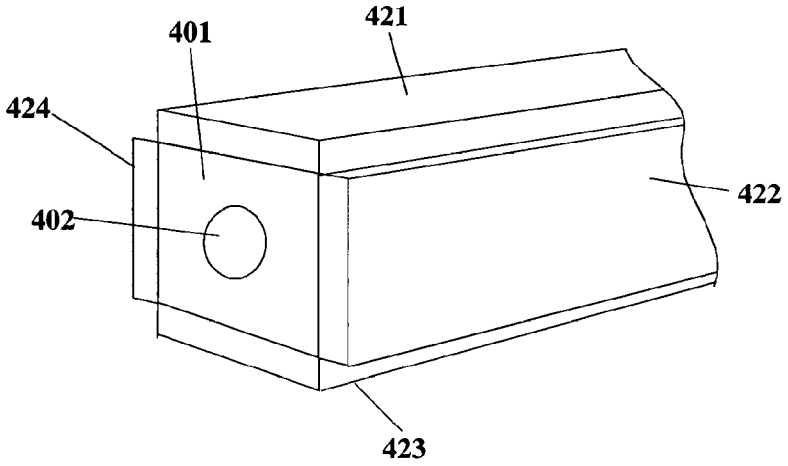
Figure 4C:
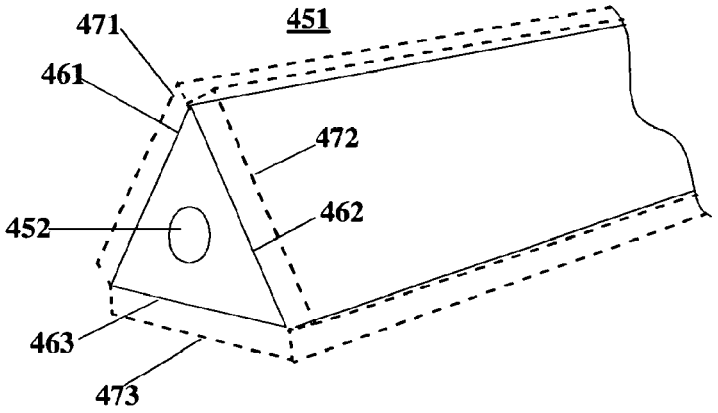

One last illustrative example for this part of the discussion is a rotating type of mounting arrangement for the instrument modules, which is similar in some respects to the Roberts Rotoneck guitar neck configuration (see for example U.S. Pat. Nos. 4,981,063 and D311,750). Referring to FIGS. 4*a*-4*c*, a polygonal cross-section mounting apparatus (for example, the square cross-section configuration 412 or triangular cross-section configuration 451) can provide a number of mounting surfaces for the various varieties of modules described earlier. As with the Rotoneck guitar neck configuration, the polygonal cross-section mounting apparatus can be mounted on a guitar body or other securing arrangement and readily rotated (on a transverse cylindrical axis) as desired by the player. Depending on the specific choices of polygonal cross-section and choice of modules, rich opportunities also exist here for two or more modules to be played simultaneously.

The various configurations described illustrate a number of concepts. Clearly these functionalities are of value in performance situations, but there are other venues for value as well. In composing, the ability to have flexible simultaneous access to multiple types of instruments and controllers allows for broad new areas of compositional trial and experimentation. One or more default configurations may be used as a compositional mainstay, and special aggregation configurations may be created as needed for unusual or new instrumentation situations. When learning about music theory, applying specific instrument techniques, working with timbre alternatives, etc. aggregated instruments offer a rich interactive and staged approach for exploration and comparative analysis. FIG. 1*c*, then, rounds out this conceptual overview of the invention by illustrating the interacting value among performance, composition, and music education. Further, with attractive physical design, the value of aggregated instruments could be further enhanced by the sheer visual appeal—performances attract more excitement and interest, student curiosity is piqued, and composing creativity can be inspired.

In addition to the visible and functional aspects described above, the invention provides for interface modules for getting signals to and from the aggregate instrument, and in some cases power to the instrument. Further, the invention provides for on-board modules of various types and implementations for signal switching, signal mixing, signal processing, and sound production, as well as various types of novelty modules (lighting, special effects, video cameras, visual display, computer interface, etc.). Overall then, at a high comprehensive level, the invention provides for arrangements and configurations of modular and aggregated instruments comprising the following broadly classified types of constituent elements:

- Aggregation frame infrastructure (mechanical, signal routing, power routing if any);
- Interface, switching, mixing, signal processing, and sound production modules;
- Instrument modules;
- Instrument sub-modules; and
- Novelty modules (lighting, special effects, video cameras, visual display, computer interface, etc.).

The remainder of the specification is organized as follows. First various types of exemplary aggregation frames will be described, including mechanical aspects, signal routing, and power routing provisions. Each such aggregation frame allows for the interchangeable incorporation of a variety of instrument modules. In many cases it may, be advantageous to support a variety of instrument module sizes. Next, a wide variety of exemplary instrument modules will be described. In many cases it may also be advantageous for at least some instrument modules to support interchangeable types of instrument submodule species. A number of such exemplary instrument sub-modules are also described. Then some illustrative exemplary novelty modules are discussed. Based on the preceding frame, module, and sub-module descriptions, a number of illustrative exemplary configurations are then provided. It is then shown how some aspects of the invention are readily extended to other forms of music technology and instrument formats, using as an example a modular floor controller. Finally, the interlaced matters of standardization, multivendor manufacturing opportunities, and instrument/market evolution are briefly considered.

2. Instrument Aggregation Frames and their Infrastructure

Although exemplary instrument modules have not yet been discussed in detail, the introductory discussion and associated figures provide enough background to explain instrument aggregation frames and related infrastructure which may be provided to hosted instrument modules.

In general, the instrument aggregation frames and their infrastructure may comprise the following:

- Mechanical mounting—exemplary mounting formats include:
  - Planar (for example, as in FIG. 2*a*)
  - Curved
  - Staircase (for example, as in FIG. 2*b*)
  - Rotating (for example, as in FIGS. 7*a*-7*g*)
- Signal routing, shielding, and signal grounding (harnesses)—exemplary signal types include:
  - Audio
  - Control
  - Video
- Power routing and protective grounding—exemplary powering classes include:
  - Low power (for simpler signal processing, controllers, etc.)
  - Moderate power (for more power consuming signal processing, lighting, video, power amplifiers, electromechanical devices, etc.).

2.1 Mechanical Mounting

In some embodiments, the invention provides for a wide range of mechanical types and implementations of the aggregation frame. Only a few exemplary approaches are provided here, but the invention provides for additional implementations deriving from or alternative to these as one skilled in the art would appreciate.

FIG. 5 shows some exemplary module fastening approaches for securing instrument modules (and additional related modules) to the aggregation frame. FIG. 5*a* illustrates an exemplary mounting strap 500 comprising a load-bearing layer 501 and a vibration-isolating and/or protective-material layer 502, both penetrated by a fastener hole 503. In this example, the mounting strap load-bearing layer 501 may be made from a rigid, semi-rigid, or flexible material, preferably of light weight with sufficient strength and durability, while layer 502 may be made of a material like rubber, foam, etc. In this example, layer 502 may be secured to the mounting strap load-bearing layer 501 with an adhesive or fastener, or alternatively may be unattached to the load-bearing layer 501. In another implementation, a suitable material may be used to perform both functions simultaneously and thus replace both 501 and 502 with a single common entity. The fastener hole 503 may be threaded or unthreaded as may be useful in various configurations and implementations. Alternatively, other fastening arrangements may be employed in this role which may involve arrangements that do not involve a fastener hole 503.

Figure 5A:
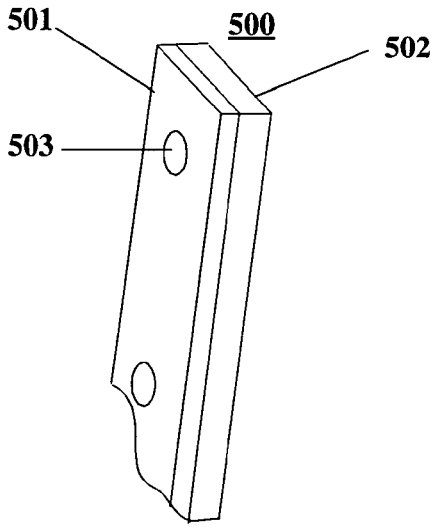
FIGS. 5*a*-*f* show exemplary module fastening approaches for securing instrument modules (and additional related modules, such as signal processing or sound production modules) to an aggregation frame.
Figure 5B:
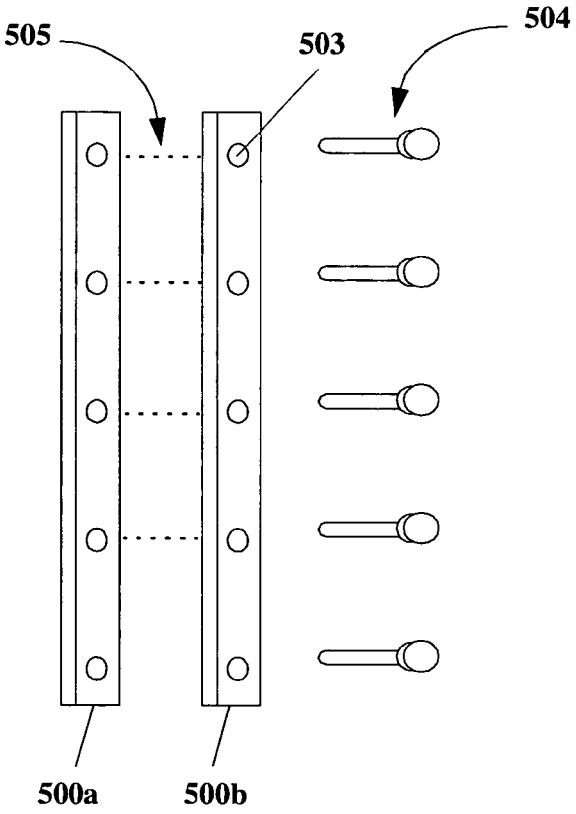

Next, FIG. 5*b* provides an example of how mounting straps 500*a*, 500*b* may be used in conjunction with a number of fasteners 504 linking the mounting straps through fastener holes 503. This configuration forms a simple planar aggregation frame for securing a plurality of instrument modules. In this exemplary arrangement, instrument modules of uniform thickness may be secured within gaps 505 between the fastener holes 503.

Figure 5C:
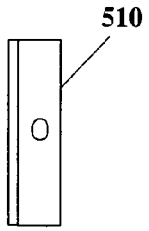
Figure 5D:
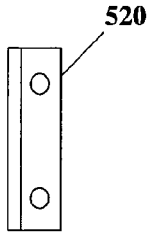

FIGS. 5*c* and 5*d* show variations where the function of one of the mounting straps 500*a*, 500*b* is replaced by individual mounting plate segments 510 or 520, each sized to separately secure an individual instrument module. These arrangements are typically far more practical as each instrument module may be separately installed or swapped without disturbing the mounting of other instrument modules. The arrangement of FIG. 5*c* uses a single fastener 504 to secure each individual mounting plate segments 510, and as a result, would likely require each instrument module so secured to comprise a hole or slot for the fastener 510 to travel through. The arrangement of FIG. 5*d* uses the double fastener arrangement 504*a*, 504*b* to secure each individual mounting plate segment 520. In this arrangement, instrument modules so secured would not require holes or notching if the distance between fastener holes of each individual mounting plate segment 520 is sufficiently large.

Figure 5E:
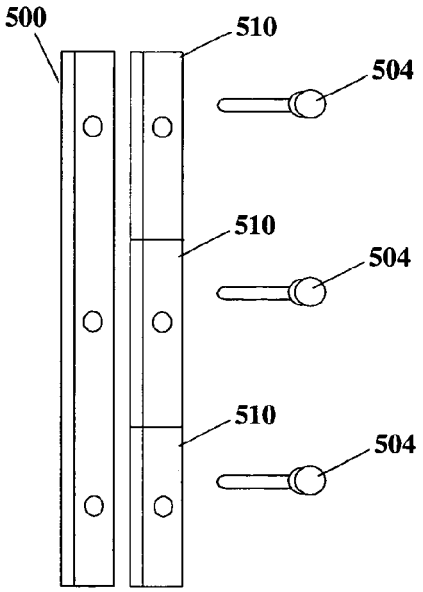

FIG. 5*e* shows several single-fastener mounting plate segments 510 attached to a common mounting plate; here the mounting strap 500 is flat, and adjacent mounting plate segments 510 abut one another. The abutment may be a simple alignment of adjacent edges, or may include securing embellishments such as tongue-and-groove, complementary notching, etc. Similarly, as shown by FIG. 5*f*, several double-fastener mounting plate segments 520 may be attached to a common mounting plate; here the mounting strap 500 is flat, and adjacent mounting plate segments 520 abut one another in various ways.

Figure 5F:
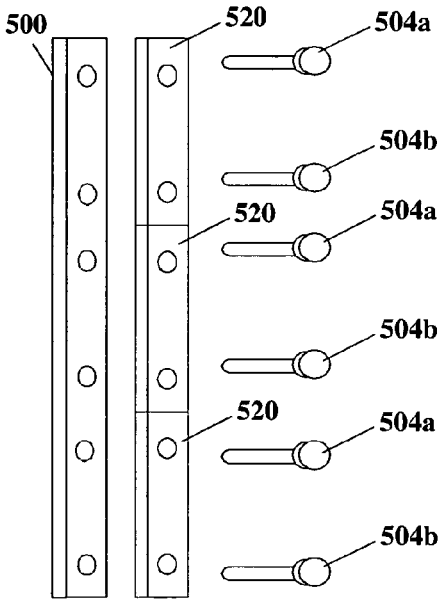

It is understood that adjacent mounting plate segments 510 and 520 in FIGS. 5*e* and 5*f* may be separated by a gap, and the gap may complement protrusions from the mounting straps. Further, the mounting straps 500, 500*a*, 500*b* may be flat, as suggested in FIG. 5*e*, or curved. Any of the individual mounting plate segment arrangements of FIGS. 5*c* and 5*d* may be applied to staircase forms of mounting frames such as the examples depicted in FIG. 2*b* and FIG. 6, as well as the rotating arrangements of FIGS. 4*a*-4*c*.

Figure 6A:
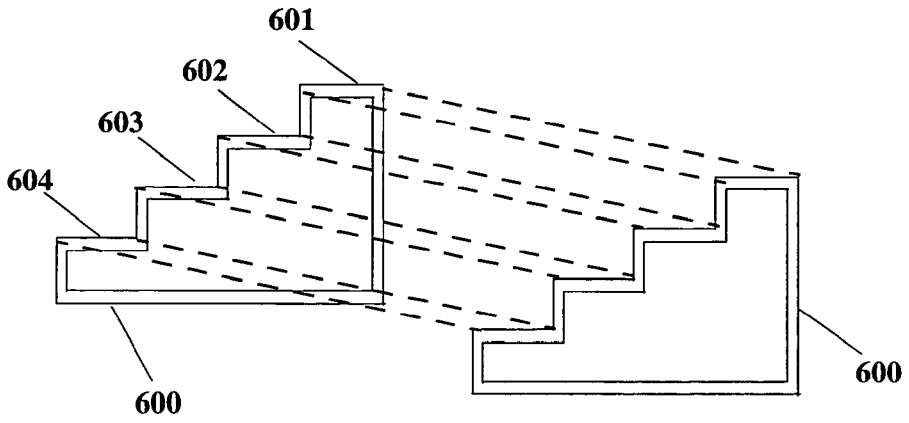
FIGS. 6*a*-6*b* depict an illustrative lightweight supporting frame facilitating a staggered arrangement with an exemplary profile.
Figure 6B:
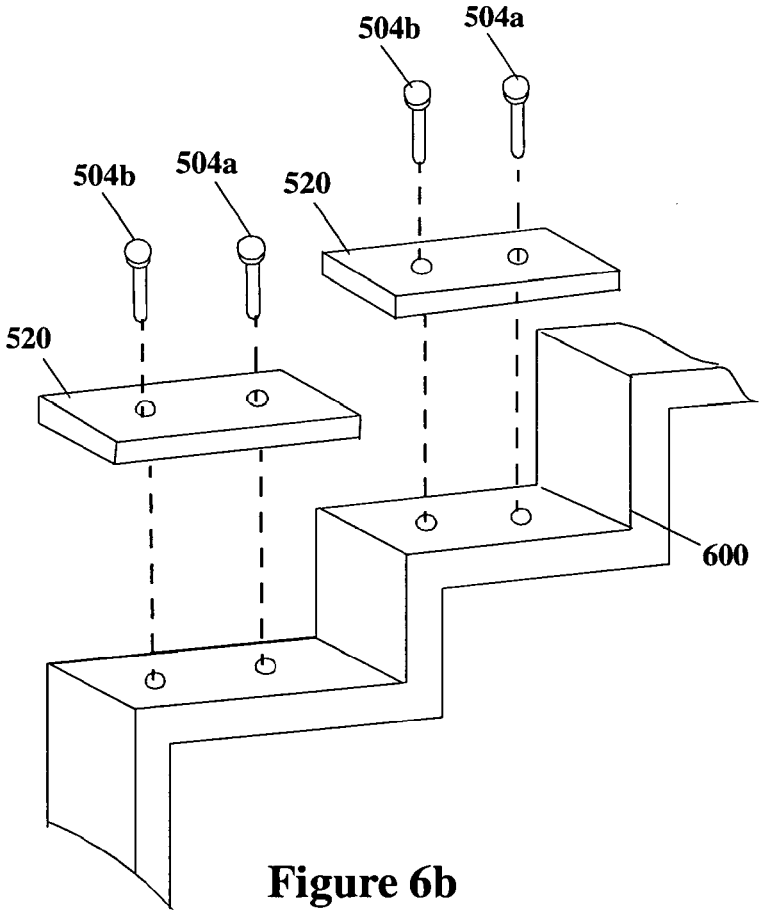

FIGS. 6*a*-6*b* are a more detailed view of staircase configuration of a mounting frame. More specifically, FIG. 6*a* shows an exemplary staircase arrangement featuring two staircase frames 600 providing four mounting areas 601, 602, 603, 604, shown in dotted lines, for instrument or controller modules. Such a frame, its equivalents, or alternatives may be used to create the staircase module instrument assembly shown in FIG. 2*b*. In this example, individual double-fastener mounting plates 520 are used along with fasteners 504*a*, 504*b* to secure into the staircase frame 600. The fastener holes in staircase frame 600 may be threaded or contain some other mating fastener arrangement (such as a twist-lock). Further, another embodiment may omit the use of individual mounting plates 510,520, instead securing the instrument modules directly to the mounting frame.

Some exemplary rotating mounting arrangements will now be considered. In some situations it is desirable for the rotation mounting arrangements to accept instrument modules—thus acting as an aggregate instrument mounting frame—and in other situations it is desirable for the rotating mounting arrangements to themselves serve as a module within a standardized aggregate instrument mounting frame. In some cases, it may be desirable for a rotation mounting arrangement to serve both of these roles. In these cases, it would be highly advantageous if the instrument modules, the rotating mounting arrangements, and the aggregate instrument mounting frames all work within a standardized size format so that a given instrument module could fit in either the rotating mounting arrangement or an aggregate instrument mounting frame that could also simultaneously hold the rotating mounting arrangement. The invention provides for this as well, and an example systems-level strategy will be provided.

Returning to FIGS. 4*a*-4*c*, two exemplary rotating mounting arrangements for securing instrument modules are shown. In FIG. 4*a*, a rectangular cross-section rotating mounting arrangement 401 is shown with surfaces 411, 412, 413, 414 and a fitting 402 for accepting a rotating load-bearing axle. FIG. 4*b* shows instrument modules 421, 422, 423, 424 attached respectively to the surfaces 411, 412, 413, 414 of the rectangular cross-section rotating mounting arrangement 401. This attachment may be made with individual mounting plate segments 510 or 520, or with other arrangements. FIG. 4*c* illustrates another rotating mounting arrangement 451 with surfaces 461, 462, 463, and fitting 452 for accepting a rotating load-bearing axle; instrument modules 471, 472, 473, shown in dotted lines, attached respectively to surfaces 461, 462, 463. Rotating mounting arrangements of other cross-sections may also be implemented. In these examples, the rotating mounting arrangements serve as aggregate instrument mounting frames for a plurality of instrument modules as discussed above.

Note that the mounting arrangements depicted in FIGS. 4*b* and 4*c* show notches formed by the edges—for example an approximate 90° notch between the edges of instrument modules 421 and 422 and an approximate 120° wedge between the edges of instrument modules 471 and 472. Such edges can be reduced or essentially eliminated by providing cavities in the rotating mounting arrangement 401 or 451 in which instrument modules 421, 422, 423, 424 and 471, 472, 473, respectively, may be recessed. The rear mounting surfaces of the instrument modules, then, would typically have a compatible shape for their stable mechanical mating or securing within the cavity. In some cases, the use of such cavities, arched or stair-step in cross-section, may be helpful in stabilizing and securing the instrument modules in any aggregating frame type (coplanar, staircase, curved, or rotating).

Figure 7A:
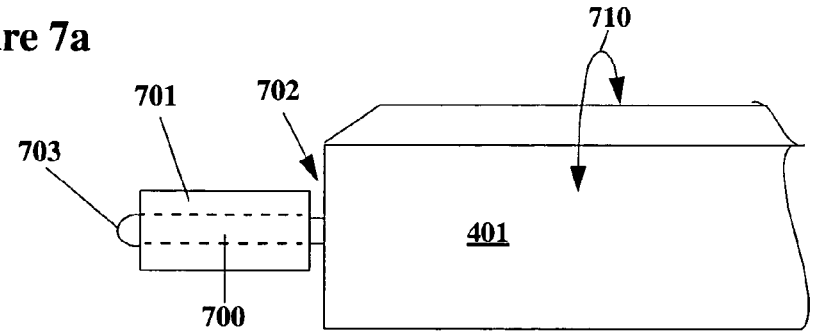
FIGS. 7*a*-7*g* illustrate the structure and application of a rotating mounting arrangement for use in a wide range of aggregate instrument configurations.
Figure 7B:
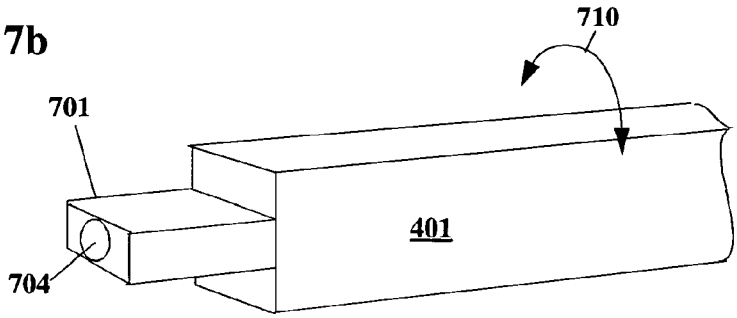

It is also possible to secure a rotating mounting arrangement similar to that depicted in FIGS. 4*a*-4*c* into another type of mounting frame. For example, FIG. 7*a* shows a representative rotating mounting arrangement 401 with a rotating axle 700 that permits partial or full rotation 710 when fitted into the rotational fitting 402 of FIG. 4*a*. In general, the rotating axle 700 is at least partially enveloped by an end-supporting member 701 comprising some form of rotation bearing. The rotation bearing may be such that the rotating axle 700 is rigidly separated from the rotating mounting arrangement 401, maintaining a gap 702. If desired, the separation gap 702 may be filled with a rotation-facilitating gasket, spring, bearing, or other device. Additionally, the axle 700 and/or rotation bearing may be configured with a protruding structure 703 emergent from the far end of the end-supporting member 701, or may terminate effectively at the edge of the far end of the end-supporting member 701 with a flush structure 704 as shown in FIG. 7*b*.

Figure 7C:
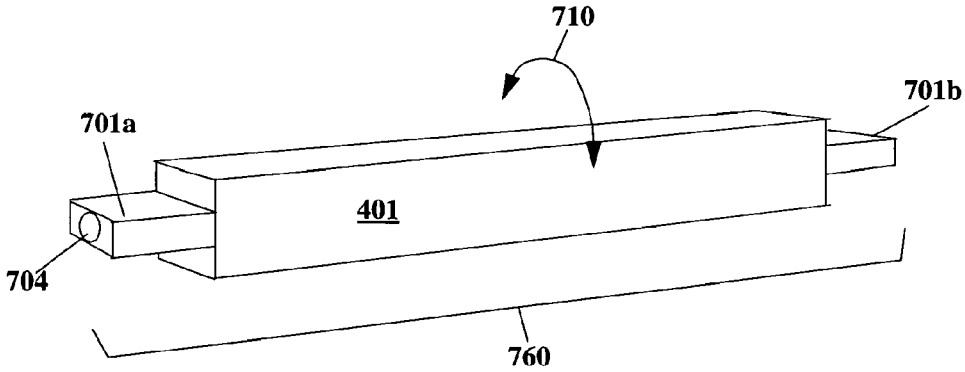

FIG. 7*c* shows a more comprehensive view of rotating mounting arrangement 401, including a complementary pair of end-supporting members 701*a*, 701*b*, each configured to be supported in a mounting frame (for example such as those depicted in FIGS. 5*f* and 6*b*), resulting in the composite mountable structure 760. In these examples, the rotating mounting arrangements serve as instrument modules which can themselves be secured in an aggregate instrument mounting frame as discussed earlier.

It is noted that various systems-level mechanical design strategies may be devised to allow various instrument modules to be interchangeably mounted directly into mounting frames (such as those depicted in FIGS. 5*f* and 6*b*), or first into a rotating mounting arrangement such as 760 which itself may be mounted into mounting frames (such as those depicted in FIGS. 5*f* and 6*b*).

Figure 7D:
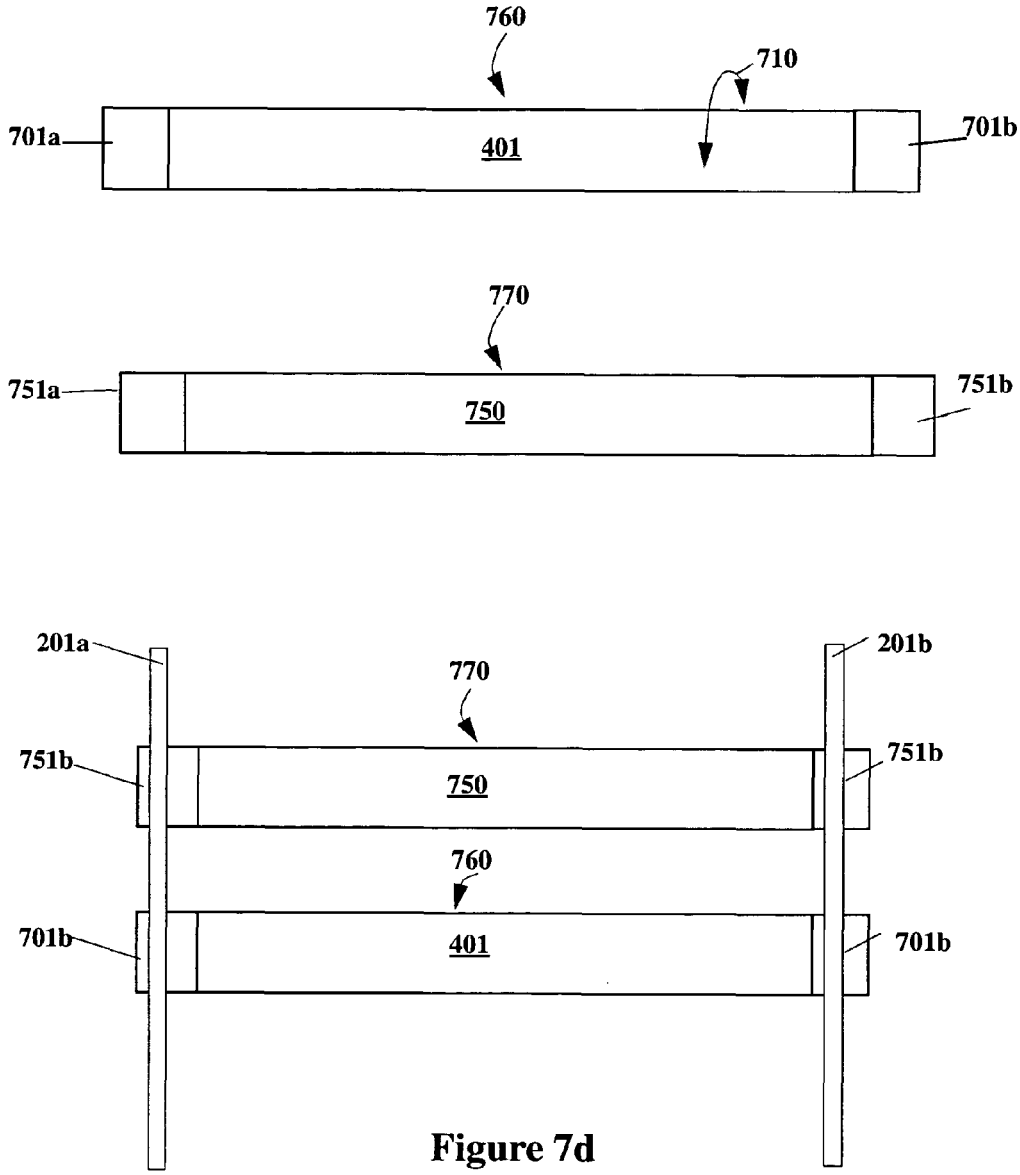

FIG. 7*d* is an example of such a systems-level mechanical design strategy. This figure provides an example of how an instrument module or related structure may be standardized with an isolated profile 750 which can either be mounted onto a rotating mounting arrangement such as 401 (or equivalently 451) within a composite mountable structure 760. In the exemplary systems-level mechanical design strategy, the instrument module or related structure may alternatively be supplemented with attachable mounting structures 751*a*, 751*b* to form an elongated module 770 of standardized profile matching that of the composite rotating supporting structure 760. In a nested standardization, a given instrument module or related structure 750 may be mounted in a fixed position structure 770 or a rotating structure 760, and instances of each may be interchangeably or simultaneously mounted in a common frame 201*a*, 201*b*.

With the various types of aggregate instrument mounting frames and related systems-level mechanical design strategies of equal, broader, or lesser scope, established, it is further noted that it is also possible to use the same instrument modules in other settings. Some additional examples are disclosed in later figures (using standardized instrument modules as ad hoc components in constructing "home-made" functional replicas of Harry Parch instruments, illustrated in FIGS. 20*a*-20*b* and 21*a*-21*b*).

Figure 7E:
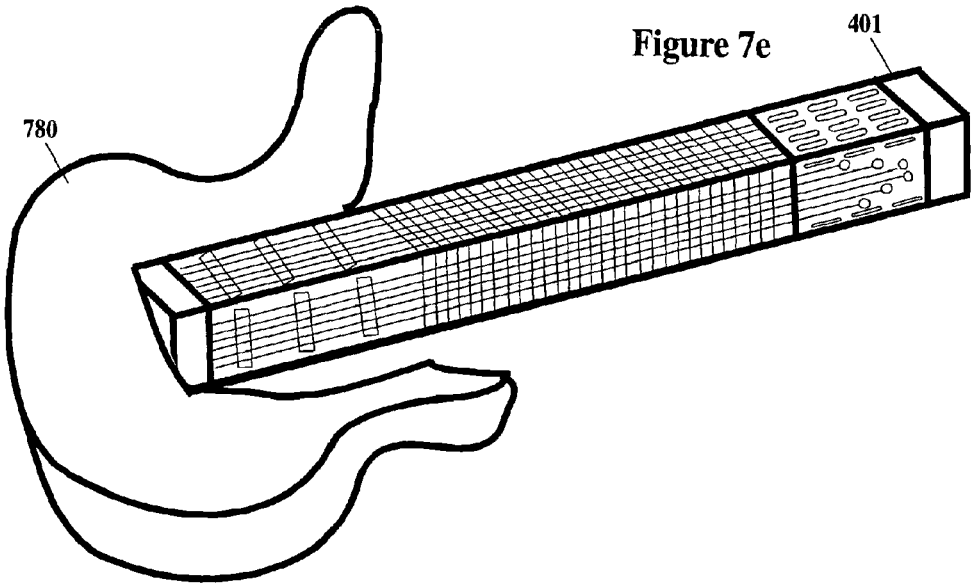
Figure 7F:
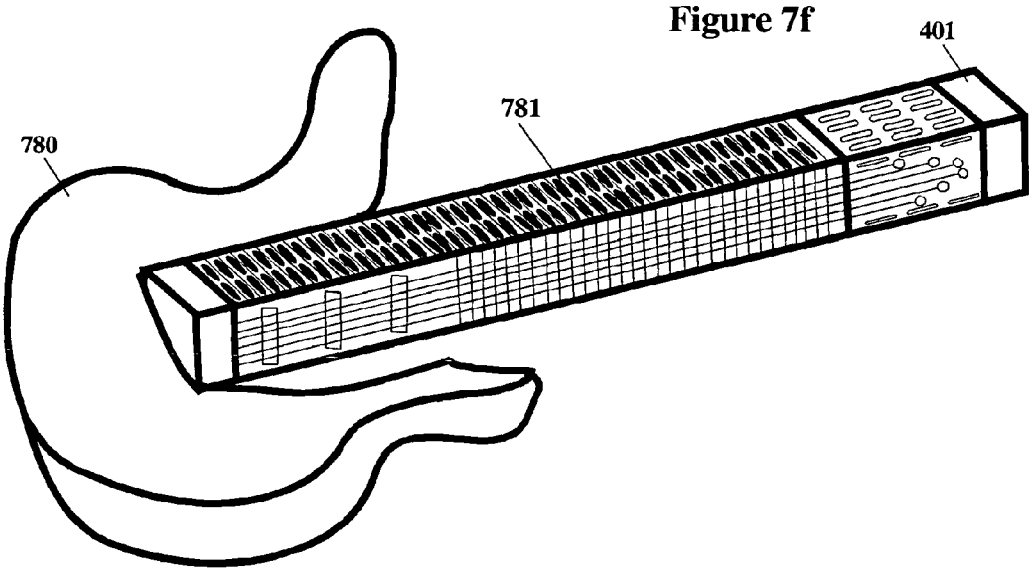
Figure 7G:
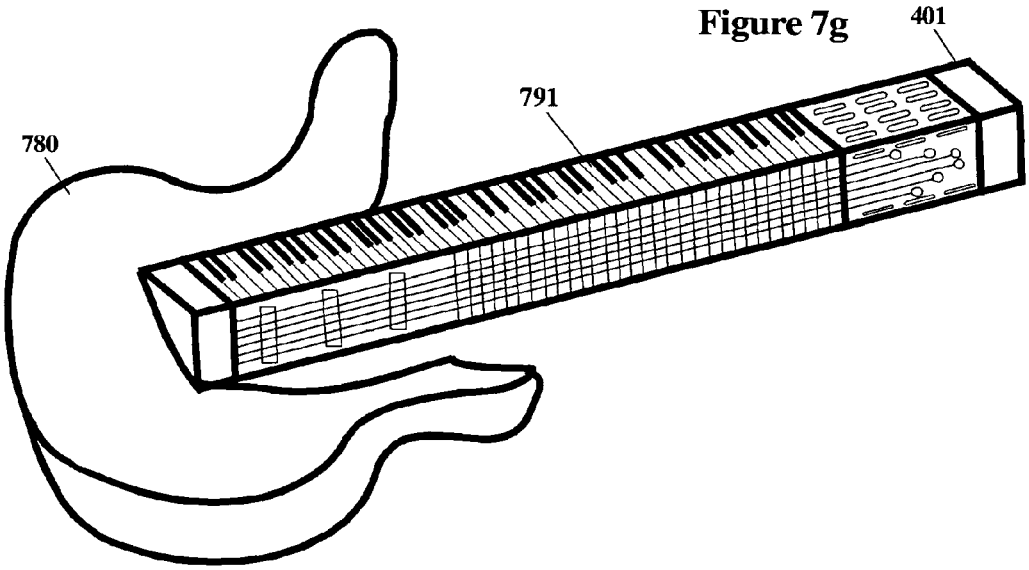

FIGS. 7*e*-7*g* show body 780 securing a single rotating mounting arrangement 401. Within the rotating mounting arrangement 401 various instrument modules may be added. FIG. 7*e* depicts a version with various types of guitar-like instrument modules inserted. These instrument modules may include various types of 6-string and 12-string metal string guitars and bass guitars, but may further readily include many additional types of specialty stringed instrument modules such as nylon-string guitar, sitar, banjo, oud, fretless bass, etc. FIG. 7*f* shows a configuration where at least one of the instrument modules comprises a collection of buttons or sensors 781 (which may be operated by the thumb, for example, while playing a guitar instrument module as well as other modes of operation). When operated by the thumb, sensors or buttons may have a repeated function that can be executed in any hand position needed while playing the guitar instrument module, or may be arranged to have differing interpretations related to the hand position needed while playing the guitar instrument module (for example, pitch or key related, or timbre-shifting roughly correlated to fingering-determined string vibration length).

FIG. 7*g* shows another configuration where one of the instrument modules is a multiple-octave miniature keyboard 791. It is noted that a readily-playable miniature keyboard of the scale of 4 inches per octave of keys, similar to that used in the Realistic™ Concertmate-350 (Radio Shack Cat. No. 42-4008, Tandy Corporation, Forth Worth, Tex.), is such that the length of a standard guitar neck would readily accommodate 4 to 6 octaves of keys. Other types of modules, such as sensor or control arrays of more arbitrary form than that suggested by FIG. 7*f*, such as light modules, fog generators, etc., could also be readily and interchangeably incorporated into this configuration.

2.2 Electrical and Signal Distribution Overview

The next two subsections discuss signal routing, shielding, grounding, and power distribution to the various types of infrastructure modules, instrument modules, instrument submodules, and novelty modules. The various types of modules may access signal routing, shielding, grounding, and power distribution through connectors. In many implementations, shielding, grounding, and power distribution may be largely implemented in a distribution bus fashion. At the connector point, localized isolation circuits may be provided to isolate electrical noise processes within the bus and within modules from one another.

Signal interconnections may be point-to-point among specific pairs of connectors, or may be implemented using multiple-access signal busses. The use of multiple-access signal busses is particularly natural for the distribution and exchange of control signals, but could be viewed as a significant new step over long standing traditions in intra-instrument audio signal handling. Due to the many configuration advantages and flexibilities afforded by the introduction of a digital audio signal bus (such as the natural I/O utility in conjunction with digital mixing and digital signal processing), along with the radically dropping prices of digital audio analog-to-digital converters (ADCs), among other factors, a digital audio signal distribution bus may be readily implemented. The audio signal bus and control signal bus could be a shared bus, and the bus technology may be either electrical or optical. The combination of optical busses and a digital audio signal bus could push noise floors within the instrument to very low levels.

2.3 Signal Routing, Signal Shielding, and Signal Grounding

The invention provides for a wide range of signal routing, signal shielding, and signal grounding types and implementations to be associated with the aggregation frame. Only a few exemplary approaches are provided herein, but the invention provides for additional implementations deriving from or alternative to these examples, as one skilled in the art will appreciate. Exemplary signal types include:

- Audio (sense transducer, processed, synthesized, drive transducer)
- Control
- Video
- Other types of signals (for example computer data signals).

Figure 8:
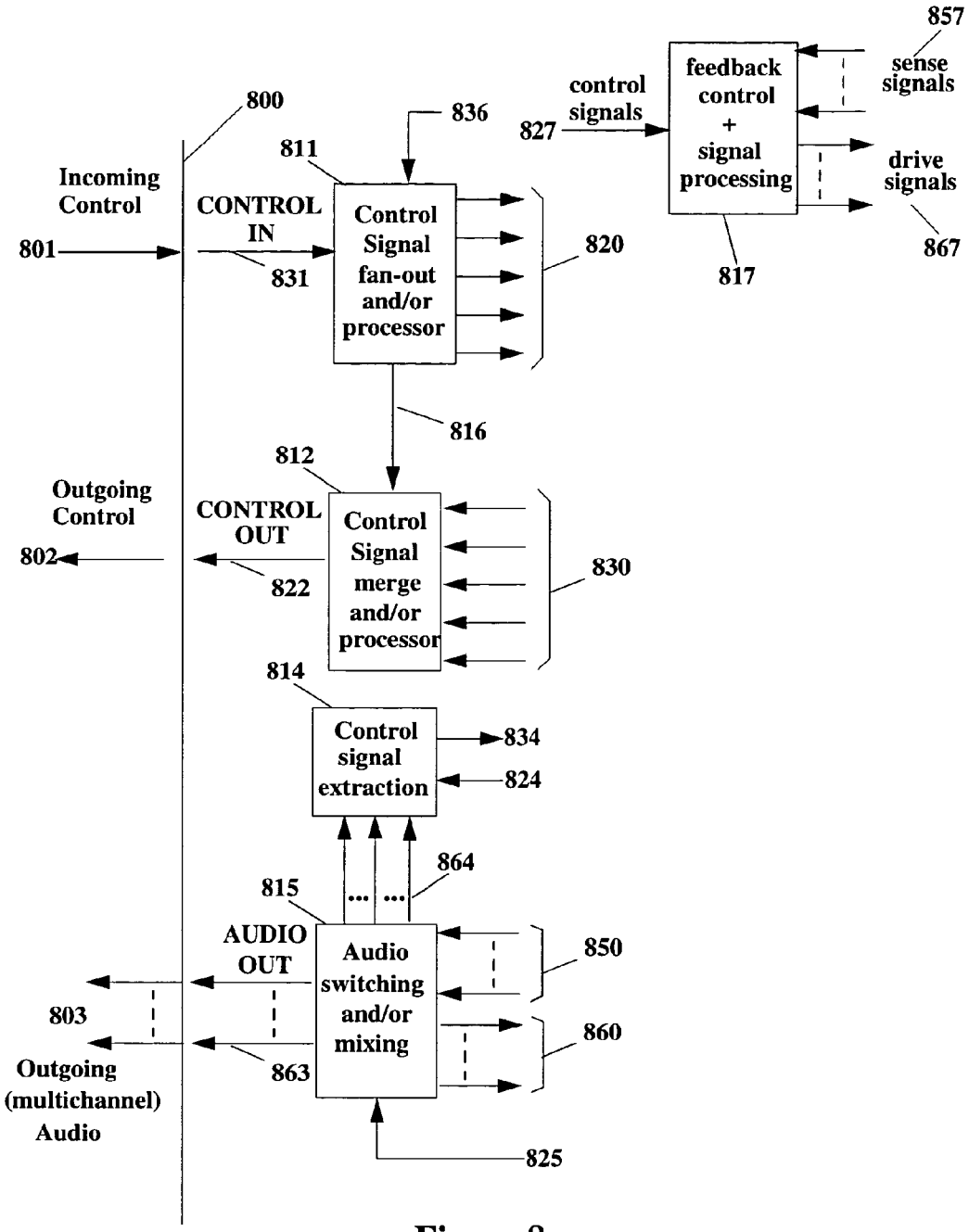
FIG. 8 depicts an exemplary audio and control signal routing environment of an illustrative aggregate instrument of moderate complexity.

FIG. 8 shows a signal routing environment of moderate complexity. For the sake of illustration, the instrument interface 800 (to be considered later in more detail) is simplified into a boundary, and the signals carried by the exemplary instrument interface only includes incoming control 801, outgoing control 802, and outgoing (multiple-channel) audio 803.

Incoming instrument control signals 801 are passed from the interface 800 (as "control in" signals 831) to a multiple-destination control signal fan-out arrangement 811 which may also include within itself control processing. In smaller-scale instruments there may be no need for multiple-destination control signal fan-out but still a need for control signal processing in which case 811 serves only a control signal processing role. The control signal fan-out and/or processor 811 may be controlled by a control signal 836 which may originate from a controller on the aggregate instrument, or from the control signal merge and/or processor element 812, described in more detail below.

Outgoing instrument control signals 802 are provided to the interface 800 (as "control out" signals 822) from a multiple-source control signal merging element 812, which may also include control processing. In smaller-scale aggregated instruments there may be no need for multiple-destination control 'signal fan-out, but still a need for control signal processing in which case 812 serves only a control signal processing role.

Outgoing instrument audio signals 803 are provided to the interface 800 (as "audio out" signals 863), by an audio switching and/or mixing element 815; this element may also potentially include audio signal processing.

In this moderate complexity example, the aggregate instrument also includes a control signal extraction element 814 which transforms attributes of provided audio signals 864 into derived control signals 834. In this example, the derived control signal transformation process provided by the control signal extraction element 814 is itself controllable in some manner by transformation control signals 824.

The aggregate instrument in this moderate complexity example also includes a vibrating element feedback excitation arrangement (using, for example, the techniques taught in U.S. Pat. No. 6,610,917) comprising a feedback control and signal processing element 817 controlled by control signals 827 and producing one or more drive signals 867 responsive to sense signals 857 originated by vibration-sensing transducers. These sense signals 857 may be originated by one or more dedicated vibration-sensing transducers or may be originated from shared vibration-sensing transducers, either directly or indirectly from the audio switching and/or mixing element 815 as described above, or from another signal source. For example, the feedback control and signal processing element 817 may be part of a self-contained module that further comprises dedicated internal vibration-sensing transducers (producing dedicated sense signals 857) and dedicated vibration-drive transducers (driven by dedicated drive signals 867). Alternatively, not only may the feedback control and signal processing element 817 obtain its sense signals 857 from elsewhere (such as audio outputs from the audio switching and/or mixing element 815), but the vibration-drive transducers may also be positioned at various locations within the instrument module, and also could serve (in another modality) as vibration-sensing transducers. These approaches enable, for example, the following demonstratively flexible configurations:

- The feedback control and signal processing element 817 may be shared across more than one instrument module.
- The feedback control and signal processing element 817 may be used in configurations involving vibration-sensing transducers of a first instrument module and vibration-drive transducers of a second instrument module. This could be used to induce sympathetic vibrations in the second instrument module. Further, if, for example, two feedback control and signal processing elements like that of 817 are configured for sharing within an aggregated instrument, a two-stage loop may be created (i.e., vibration-sensing transducers of a first instrument module may be processed by a first feedback control and signal processing element 817 to drive vibration-drive transducers of a second instrument module, while vibration-sensing transducers of the second instrument module may be processed by a second feedback control and signal processing element 817 to drive vibration-drive transducers of the first instrument module).
- A piezo bridge transducer or magnetic pickup separated from a bridge location may be configured for (mutually exclusive) use as a vibration-sense transducer or vibration-drive transducer.

It is noted that the audio switching and/or mixing element 815 may be controlled with incoming control signals 825 that may originate within the instrument and/or from the control fan-out and/or processor 811. The control signal fan-out and/or processor 811 itself may be controlled by incoming control signals 801 originating outside the instrument and/or by other control signals 815 that may originate within the instrument. Similarly, control signals originated from within an aggregate instrument (or complex instrument module) may be directed to a control signal merge and/or processor 812 which creates at least an outgoing control signal 802 for the aggregate instrument.

The control signal merge and/or processor 812 may also serve as the immediate source for the incoming control signals 825 and 827, and itself receive and be responsive to a control signal 826 provided by, for example, the control signal fan-out and/or processor 811 or other control signal source. It is noted that the instrument interface 800 may be implemented using known types of generalized instrument interfaces. Specific examples of suitable types of generalized instrument interfaces are described in U.S. Pat. No. 6,570,078.

The invention also provides for the incorporation of interfaces for other types of signals, for example computer data signals employing interfaces such as RS-232, USB, VGA, Ethernet, FireWire™, etc.; in general these interfaces may have a signal direction that is bi-directional (outgoing and incoming), incoming-only, or outgoing-only.

Figure 9A:
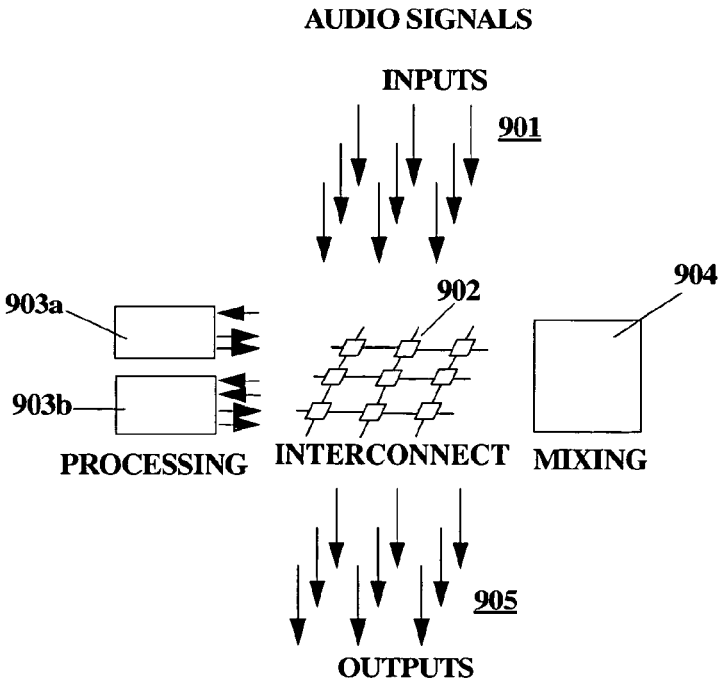
FIGS. 9*a*-9*e* show a more general arrangement for the handling of audio and control signals within an aggregate instrument (or complex instrument module)

It is understood by one skilled in the art that the configuration depicted in FIG. 8 is but one example of a suitable interface that may be implemented, and that a wide range of additional configurations and signal types are possible. A more comprehensive range of implementations provided for by the invention is further elaborated in FIGS. 9*a*-9*e*. For example, FIG. 9*a* shows a more general arrangement for the handling of audio signals within an aggregate instrument (or complex instrument module). Audio inputs 901 from various sources within an aggregate instrument (or complex instrument module), and possibly from the instrument interface (such as 800 in FIG. 8), or other known types of generalized instrument interfaces, are provided to a interconnection fabric 902. The interconnection fabric 902 may be a fixed configuration, comprising mechanical or electronic switching, or comprising a fixed or controllable mixing matrix. The interconnection fabric 902 further provides one or more audio outputs 905 which may be directed to the instrument signal interface (such as 800 in FIG. 8 or other known types of generalized instrument interfaces), or elsewhere (such as drive transducers, internal amplifiers for self-contained sound production, etc.). The interconnection fabric 902 may further connect with various types of audio signal processing elements featuring one 903*a* or more 903*b* audio inputs and one or more audio outputs. The interconnection fabric 902 may further connect with a multiple-channel mixer 904, particularly if the interconnection fabric 902 itself does not internally comprise a fixed or controllable mixing matrix.

Figure 9B:
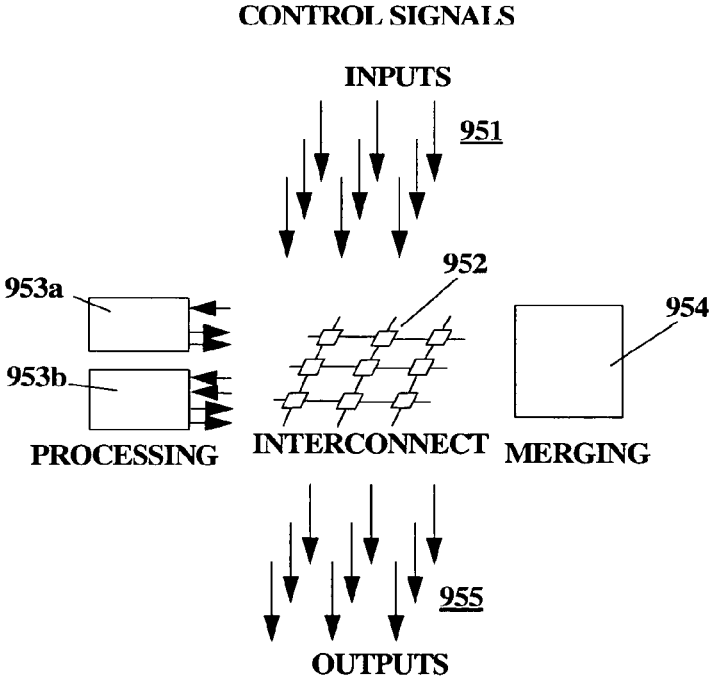

FIG. 9*b* illustrates a comparable general framework for the handling of controls signals within an aggregate instrument (or complex instrument module). Control signal inputs 951 from various sources within an aggregate instrument (or complex instrument module), and possibly from the instrument interface (such as 800 in FIG. 8 or other known types of generalized instrument interfaces), are provided to an interconnection fabric 952. The interconnection fabric 952 may be a fixed configuration, comprising mechanical or electronic switching, or comprising a fixed or controllable control signal merging environment. The interconnection fabric 952 further provides one or more control signal outputs 955 which may be directed to the instrument signal interface (such as 800 in FIG. 8 or other known types of generalized instrument interfaces), or elsewhere (such as internal light modules, self-contained sound amplification, etc.). The interconnection fabric 952 may further connect with various types of control signal processing elements featuring one 953*a* or more 953*b* audio inputs and one or more audio outputs. The interconnection fabric 952 may further connect with a multiple-channel mixer 904, particularly if the interconnection fabric 952 itself does not internally comprise a fixed or configurable control signal merging environment.

An aggregate instrument (or complex instrument module) may include additional novelty items useful in performance. Novelty items may include lighting, special effects, video cameras, visual display, computer interfaces, etc. Of these, it is noted that a video camera can be used as a musical instrument or music system control interface, as in the examples described in U.S. Pat. No. 6,570,078. For example, various types of image processing and recognition steps may be employed to derive control signals responsive to images or motions within the captured video signal. Thus an instrument module or submodule may use video internally to create control signals, but video need not travel to or through other parts of the aggregate instrument or instrument module. In other arrangements, particularly if video is used for other purposes than creating or controlling musical sounds, video may indeed travel through other parts of the aggregate instrument or instrument module. Should the aggregate instrument employ video signals outside the context of an instrument module or sub-module, an embodiment of the invention may provide a video signal infrastructure. Typically the video capabilities, if present, would be considerably simpler than that of the audio and control signal environments. However, as may be required or desired, video switching, video signal processing, video merging (blend, fade-to, etc.), and video mixing (mosaic, split-screen, wipe, etc.) may be included, and video signals incoming and outgoing from the aggregate instrument may be included in the instrument interface.

Figure 9C:
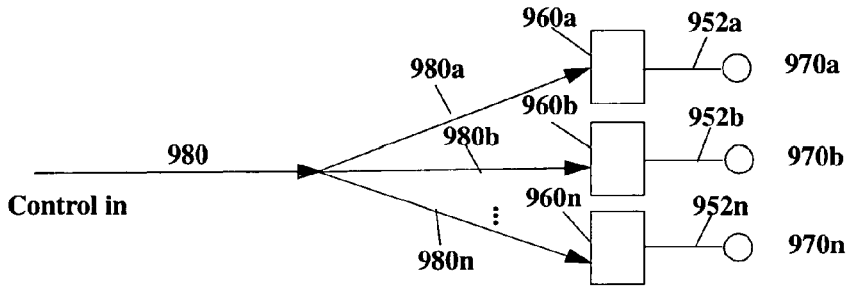
Figure 9D:
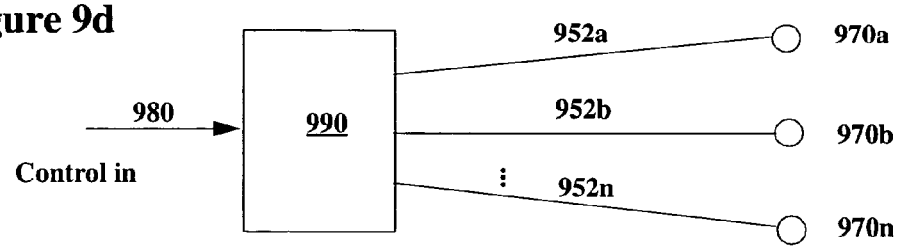
Figure 9E:
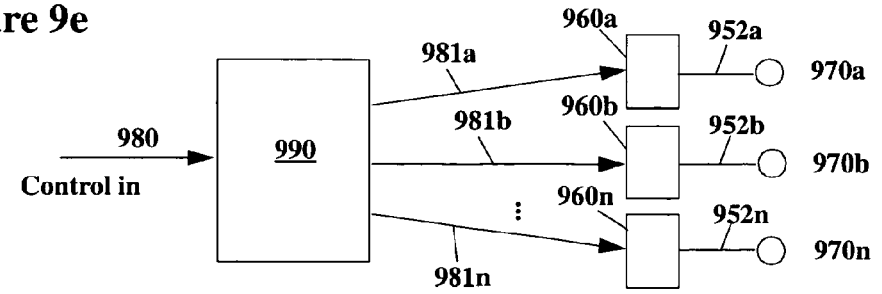

Lighting and special effects are typically driven by control signals. FIGS. 9*c*-9*e* illustrate various techniques for handling these types of control signals. For example, in FIG. 9*c*, applicable control signals 980 are fanned-out over physically distributed paths 980*a*-980*n* to intelligent interpreting elements 960*a*-960*n*, which in turn create modulated power or other types of more primitive control signals 952*a*-952*n*. These primitive control signals 952*a*-952*n* are then communicated to relatively non-intelligent lighting or special effect elements 970*a*-970*n*, which may internally comprise lights, motors, solenoids, piezo elements, heating elements, sparkgaps, valves, pumps, etc. FIG. 9*c* shows an arrangement with one relatively non-intelligent lighting or special effect element 970*a*-970*n* is respectively associated with each intelligent "interpreting" element 960*a*-960*n*, where each intelligent interpreting elements 960*a*-960*n* may control more than one relatively non-intelligent lighting or special effect element.

FIG. 9*d* shows this taken to the extreme where a single comprehensive intelligent interpreting element 990 directly creates more primitive control signals 952*a*-952*n* for all of the relatively non-intelligent lighting or special effect elements 970*a*-970*n*. FIG. 9*e* shows an exemplary third arrangement where a single intelligent interpreting element or protocol converter element 995 creates specialized control signals 952*a*-952*n* directed to lower-level intelligent interpreting elements 960*a*-960*n*, which in turn create the primitive control signals 952*a*-952*n* for all of the relatively non-intelligent lighting or special effect elements 970*a*-970*n*. A specific example of a protocol conversion would be where the applicable control signals 980 are of MIDI format and the specialized control signals 952*a*-952*n* are of DMX format (commonly used in stage-scale lighting and special effects systems). The invention also provides for instrument aggregates and individual instrument modules and sub-modules to employ computer interfaces and signals such as RS-232, USB, VGA, Ethernet, FireWire™, etc. These signals may be supported by special provisions or by configurations similar to those illustrated thus far for audio, control, and video signals. In particular, this may include computer data signal routing and processing.

Within an aggregate instrument (or complex instrument module) the various audio and control signals having internal sources or destinations will typically need to connect with various instrument modules or related systems. Connectors with space-division (one physical path per signal) wiring may be used, or signals may be multiplexed together utilizing time-division, frequency-division, wavelength division, or other suitable multiplexing methodologies. Signal connections may be electrical, optical, or both in combination. Electrical signals may be carried over balanced or unbalanced circuits. Connectors may connect with various instrument modules or related systems via a flexible cable harness or a fixed-position connector, which may comprise part of the physical mounting arrangement involved in securing the various instrument modules or related systems to the mounting frame.

The invention provides for various individual interconnection fabrics (audio 902, control 952, video, etc.) to be realized in part or in whole with a multiple I/O port signal bus. Further, the invention provides for two or more signal types (audio in, audio out, control in, control out, video in, video out, etc.) that are carried across the connector to be multiplexed together as may be required or desired in a particular application. In one very flexible and evolvable arrangement, all signal types are multiplexed together and connectors with the various instrument modules or related systems share at least a common interconnection fabric. Finally, the invention provides for any needed signal ground to either be included in the connectors, provided by the mechanical mounting arrangements (for example, mounting-screw 504 sites 503 with the mounting frames), or an appropriate combination of both methodologies. It is noted, however, that in certain implementations, for example where all signals are carried optically, no signal ground may be needed.

2.4 Power Routing and Protective Grounding

The invention provides for a wide range of power routing and protective grounding types and implementations to be associated with the aggregation frame. Only a few exemplary approaches are provided herein, but the invention provides for additional implementations deriving from (or alternative to) these as one skilled in the art appreciates.

Exemplary powering classes include:

Low-current power (for simpler signal processing, controllers, etc.); and

Moderate-current power (for more power consuming signal processing, lighting, video, power amplifiers, electro-mechanical devices, etc.).

Powering could be provided on the same connectors used for handling signals, separate connectors dedicated only for powering, or in the mechanical mounting arrangements.

Exemplary standard low-current powering may involve a two-wire single power supply, a three-wire complementary split power supply, a four-wire arrangement involving a three-wire complementary split power supply for signal electronics sharing a common power ground with a logic supply, or a five-wire arrangement involving a three-wire complementary split power supply for signal electronics and a two-wire single logic power supply not sharing a common power ground with the signal complementary split power supply. Exemplary standard moderate-current powering may involve a two-wire single power supply that may or may not share a common conductor with other powering and grounding arrangements.

At each connection site in the power distribution, power supply decoupling may be employed. Such power supply decoupling may comprise low-pass filters, ferrites, bypass capacitors, series inductors, etc., and may be located within instrument modules and related systems, the mounting frame, cable harnesses, connectors, or elsewhere, and may be distributed among two or more of these systems and components. It is also understood that various voltage regulation schemes may be used. In some configurations, a common regulator may serve the entire instrument frame, but in most situations it is usually preferable to perform voltage regulation within each module. In situations where a module permits additional sub-modules that require active powering, the hosting module may provide regulated or unregulated power to the sub modules, which in turn may contain their own regulation. Certain types of modules, for example lighting or electro-mechanical devices, may not need regulation but provide controlled voltage conditions to internal elements (such as light elements, motors, solenoids, etc.) via controllable voltage-source circuitry such as emitter followers or high-current op-amps.

Protective grounding could be provided on the same connectors used for signals, on the same connectors used for powering, separate connectors, or in the mechanical mounting arrangements. In certain configurations protective grounding may share a conductor with powering. In some specialized low-power situations, the protective grounding, one conductor associated with power, and the signal ground could share a common conductor.

2.5 Instrument Interface, Switching, Mixing, Merging, Processing, and Sound Production Modules The previous section described the role of instrument interfacing, switching, mixing, merging, and processing, particularly in conjunction with FIGS. 8,9*a* and 9*b*. The following provides a more detailed description of how these features may be implemented.

2.5.1 Instrument Interfaces with External Equipment

A wide range of instrument interface types and implementations may be associated with the aggregation frame. Only a few exemplary approaches are illustratively provided here, but the invention provides for additional implementations deriving from or alternative to these as one skilled in the art appreciates.

As previously noted, a number of different types of generalized instrument interfaces may be used, including, for example, the generalized instrument interfaces disclosed in U.S. Pat. No. 6,570,078. A suitable generalized instrument interface may generally include single or multiple connectors, signals in space-division or multiplexed formats, media of electrical, optical fiber, wireless, or combinations of these. Signals carried by the generalized instrument interface include an instrument's incoming and outgoing audio signals, incoming and outgoing control signals, and incoming and outgoing video signals, as relevant to the instrument and supporting systems. Outgoing audio signals in particular, and often outgoing control signals as well, may comprise multiple channels which are well suited to the aggregated instruments described herein.

2.5.2 On-Instrument Signal Switching, Mixing/Merging, and Signal Processing

FIG. 8 shows the use of audio switching for flexibly handling the multitude of audio signals inside an aggregated instrument of moderate complexity. More specifically, the audio switching and/or mixing element 815 accepts incoming audio signals 850 from various audio signal sources (for example, vibration-sensing transducers, on-instrument synthesizer modules, signal processor outputs, etc.) and provides outgoing audio signals 863 to the instrument interface 800, outgoing audio signals 861 to the control signal extraction element 814, and outgoing audio signals 860 to other destinations (for example, drive transducers, on-instrument sound production modules, signal processor inputs, etc.). Audio element 815 may be controlled by an incoming control signal 825 (which may originate from an on-instrument controller, the control signal fan-out and/or processor 811, etc.).

FIG. 9*a* shows an abstraction of this exemplary case to a more general setting featuring possible audio switched interconnect functionality 902 and audio mixing functionality 904 which provide interconnect and mix operations on incoming audio signals 901, outgoing audio signals 905, and audio signals to and from various audio signal processing modules which may exist (such 903*a* and 903*b*). Note audio signal processors may have one input, as depicted by 903*a*, or multiple inputs, as indicated by 903*b*, as well as single or multiple outputs. The audio switched interconnect functionality 902, audio mixing functionality 904, and signal processors 903*a*, 903*b* may each be controlled by exogenous control signals (as provided in FIG. 8).

The example of FIG. 8 also illustrates various aspects of control signal fan-out, processing, and merging. FIG. 9*b* abstracts this to also include potential control signal switching. More specifically, FIG. 9*b* shows an abstraction of the exemplary case of FIG. 9*a* into a more general setting featuring possible control switched interconnect functionality 902 and control merging functionality 904 which provide interconnect and mix operations on incoming control signals 901, outgoing control signals 905, and control signals to and from various control signal processing modules which may exist (such 903*a* and 903*b*). Note that control signal processors may have one input, as depicted by 903*a*, or multiple inputs, as indicated by 903*b*, as well as single or multiple outputs. The control switched interconnect functionality 902, control merging functionality 904, and control signal processors 903*a*, 903*b* may each be controlled by exogenous control signals (as shown in FIG. 8).

Video signals, if utilized in a particular aggregated instrument configuration, are likely to be sparsely existent and require little handling or special consideration. An aggregated instrument may simply have one or more video cameras and/or video displays, and all video signals would be directly connected between these components and the instrument interface 800, as augmented to include video signals using, for example, the techniques disclosed in U.S. Pat. No. 6,570,078 as explained earlier. In more complex arrangements, video switching, video signal processing, and video signal mixing and merging may be included. Further, video may be converted into control signals or rendered under the direction of control signals using, for example, the techniques provided in U.S. Pat. No. 6,570,078. Therefore, an exemplary general arrangement may be akin to that shown by FIGS. 9*a* and 8 but with audio signals and associated audio elements are replaced with video signals and associated video elements.

2.5.3 On-Instrument Sound Production

A wide range of on-instrument sound production module types and implementations may be associated with the aggregation frame. Only a few exemplary approaches are illustrated, but additional implementations are possible within the teachings of the present invention.

Sound production modules may be implemented using a number of physical formats, output powers, sound distribution patterns, etc. For example, multi-channel configurations may be implemented in a unitary housing, a group of functionally associated modules (separate left and right tweeters/midrange, woofers, etc.), or by a plurality of individual modules of differing or equivalent types. Examples of the latter include a self-contained wide-range single-channel module that could be used for a left channel or a right channel, a subwoofer module that could be shared between the left and right channels, etc. With the modular format, additional channels of various types can be added for special purposes—for example a hexaphonic amplification system, short-throw and long-throw amplification systems, etc.

It is also readily possible for sound production modules to support one or more submodules. For example, the sound production modules may be limited to speaker and baffle combinations with insertable amplifier modules of various types associated with various brand-name manufacturers or differentiated by functions (internal equalization, distortion characteristics, damping at low frequencies, etc.). Further, the amplification modules may be limited to power amplification and co-exist with insertable pre-amplifier modules of various types associated with various brand-name manufacturers or differentiated by functions (internal equalization, distortion characteristics, double-integrator at low frequencies for sound production below the resonance frequency of a speaker enclosure). Particular examples of suitable systems that may be used to implement the amplification module are the Bag End™ Extended Low Frequency ELF™ system or the system described in U.S. Pat. No. 4,481,662 by Long and Wickersham. Alternatively, such pre-amplifier functions may be segregated out of the sound production modules altogether and be treated as a signal processing module as discussed above in Section 2.5.4.

Figure 10A:
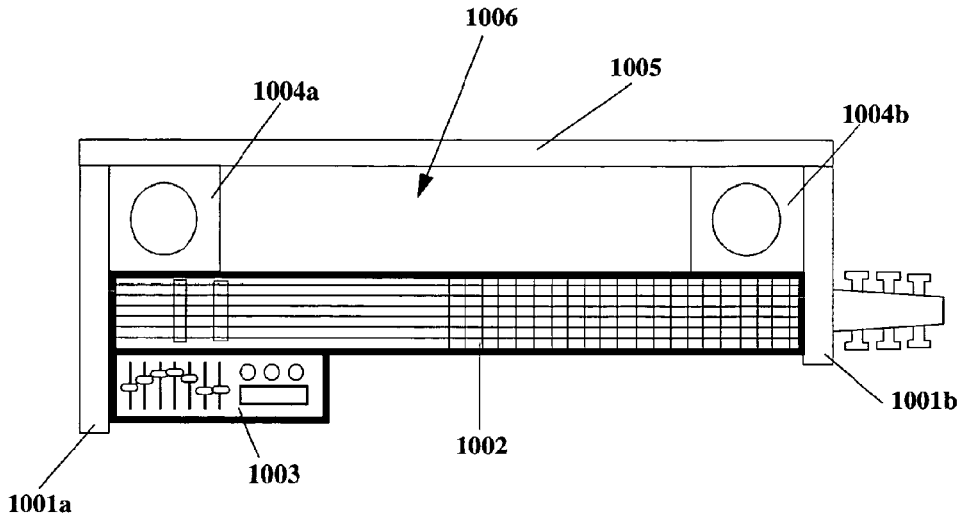
FIGS. 10*a*-10*b* illustrate possible techniques for incorporating various types of sound production modules into an instrument frame.
Figure 10B:
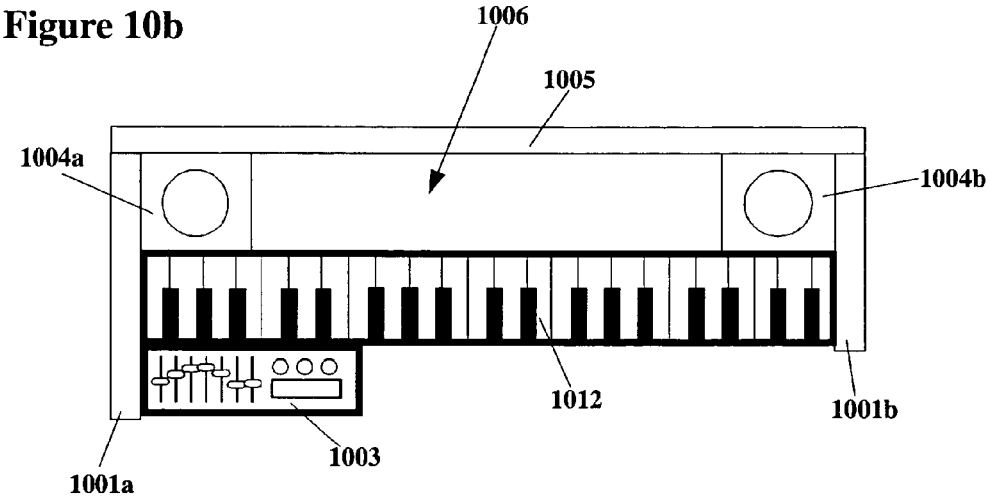

At a higher level, FIGS. 10*a*-10*b* illustrate possible techniques for incorporating various types of sound production modules into an instrument frame. FIG. 10*a* depicts an exemplary stringed-instrument configuration while FIG. 10*b* depicts an exemplary keyboard-instrument configuration. In each, two sound production elements 1004*a*, 1004*b* are included. The two sound production elements may be configured as separate modules defining a gap 1006 between them, and connected by a supporting beam 1005. Mounting elements 1001*a*, 1001*b* are shown providing additional support to the two sound production elements. Alternatively, the two sound production elements 1004*a*, 1004*b* may be incorporated into a common module wherein the volume 1006 is a structure physically connecting the two sound production elements 1004*a*, 1004*b*; here the structure 1006 may comprise electronics, subwoofers, etc. In this situation, supporting beam 1005 may not be needed or used. In another approach, the two sound production elements 1004*a*, 1004*b* may fit into a multiple-site frame, as will be described later in conjunction with later Figures; frame 1600, for example, in FIGS. 16, 17, and 18*a*-18*c*, may provide additional mounting sites for additional sound production elements, signal processing modules, pre-amplifier modules, control modules, or even miniature instrument modules (one octave keyboard, mini-zither, mbira, etc.). Once again, supporting beam 1005 is an optional component and may be omitted as may be required or desired.

FIGS. 10*a* and 10*b* also depict an additional module 1003. This module could be a signal processing module, pre-amplifier module, control module, or even miniature instrument modules (one octave keyboard, mini-zither, mbira, etc.). In the case of FIG. 10*a*, the module does not span the full distance between supporting frame elements 1001*a* and 1001*b* to provide a desired open space for user access to the neck of the stringed instrument module 1002. Although this module is shown secured to the frame element 1001*a* (and possibly the side or rear of stringed instrument module 1002), a supporting beam such as 1005 may be used without excessively interfering with user access to the neck of the stringed instrument module 1002. In the keyboard-oriented example of FIG. 10*b*, the same range of mounting options can also be applied for module 1003. Here module 1003 may additionally or alternatively include a music synthesizer, or provide control signals to a music synthesizer mounted elsewhere (for example, in the volume 1006) or within the keyboard module 1012 itself.

In many situations, it may be desirable to mount the sound production modules such as 1004*a*, 1004*b* in other locations. For example, the locations shown in FIGS. 10*a* and 10*b* may get covered from time-to-time by the musician's arms. In the stringed instrument example of FIG. 10*a*, the proximity of the instrument modules 1004*a*, 1004*b* to the stringed instrument module 1002 may cause acoustic feedback, a situation that may be either desirable or non-desirable. Thus, when feedback is not desired the sound production modules (such as 1004*a*, 1004*b*) can be mounted in locations not normally covered by the musician's arms, rather than being physically adjacent to a stringed instrument module 1002, etc., as particular needs may make advantageous. Finally, it is understood that sound production modules may be freely incorporated into an aggregated instrument design. For example, either configuration of FIGS. 10*a* and 10*b* may be further expanded to include a number of other instrument modules (stringed instruments, keyboards, percussion controllers, etc.). The mounting frame may be worn with a flexible shoulder strap, supported by a stand, etc., as in the various cases depicted in FIGS. 3*a*-3*e*, and may be a flat frame, staircase frame (as in FIG. 6*a*), curved frame, etc. The position shown occupied by the stringed instrument module 1002 of FIG. 10*a* or the keyboard module of FIG. 10*b* may be alternatively be occupied by a rotating mounting arrangement 401, which in turn supports a plurality of various instrument modules as previously described.

3. Instrument Modules

A wide range of instrument module types and implementations may be associated with the aggregation frame. Although a few exemplary approaches are illustrated, additional implementations may be implemented to accommodate the requirements of a particular application.

3.1 Stringed Instrument Modules

In accordance with some embodiments, a wide range of stringed instrument modules and associated sub-module configurations may be implemented. These include, but not limited to, various forms of guitars, basses, dulcimers, banjos, mandolins, mandolas, sitars, pipas, biwas, violins/cellos, ouds, shamisans, kotos, harps, zithers, and many other related instruments.

Figure 11:
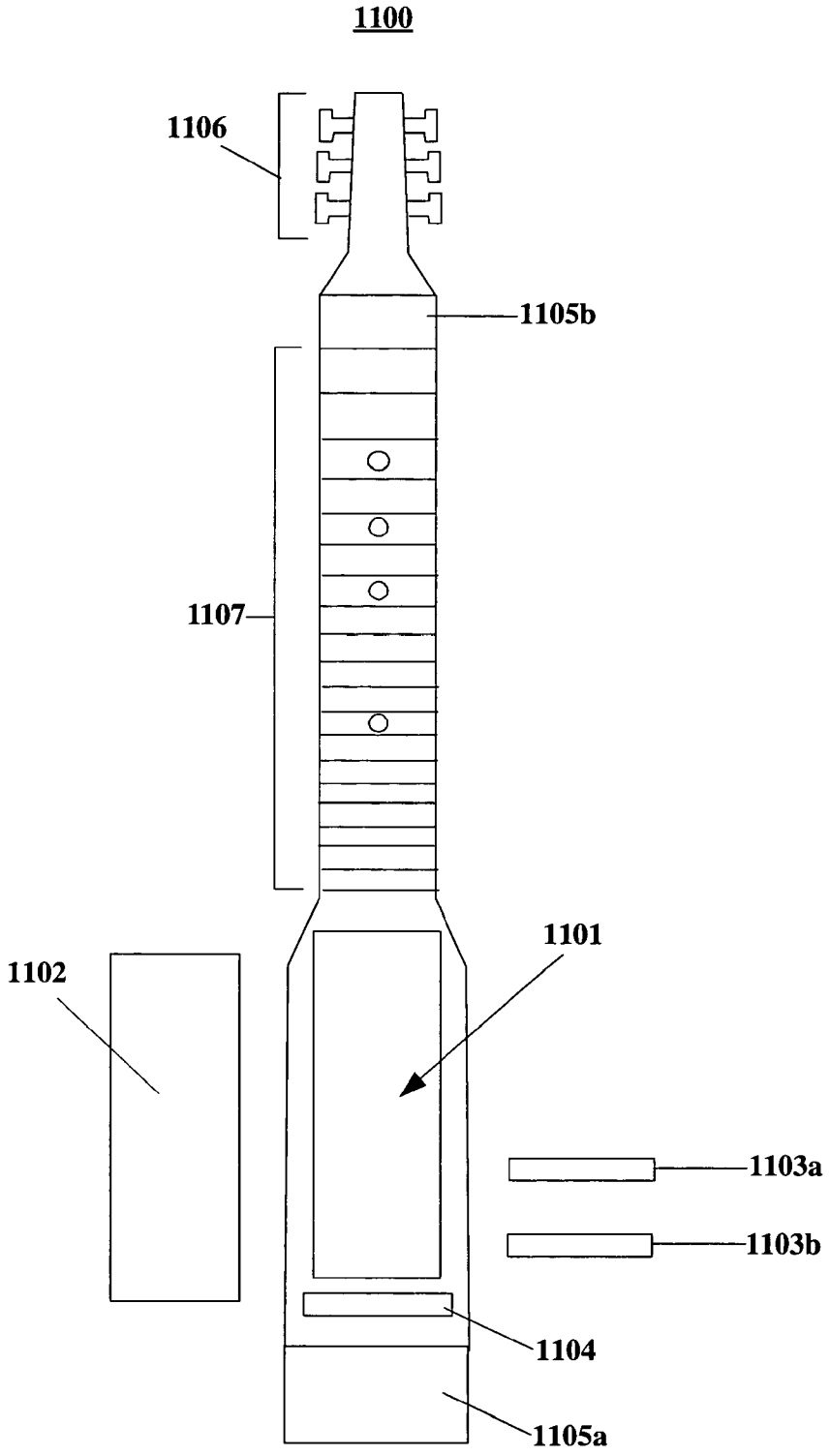
FIG. 11 depicts some basic aspects of stringed instrument modules and associated sub-module configurations utilizing an exemplary guitar module.

Some basic aspects of stringed instrument modules and associated sub-module configurations will be described with reference to the exemplary guitar module 1100 shown in FIG. 11.

In this figure, the exemplary guitar module 1100 is shown with an array of tuners ("tuning heads") 1106 which may use gears, screw cantilevers, etc. to vary the tension of strings. This particular module also features a fretted neck array 1107 which may be an integral part of the module 1100, or an installable sub-module (as will be described in conjunction with FIGS. 13*a*-13*b* and 14*a*-14*i*). This particular module further features mounting areas 1105*a*, 1105*b* for mounting into frames, in which the array of tuners 1106 and the affiliated structure extends beyond the confines of the frame boundary (as depicted in the configurations of FIGS. 2*a* and 10*a*). Configurations where the array of tuners lies within the confines of the frame boundary will be described in more detail with respect to FIGS. 12*a*-12*c*.

The exemplary guitar module 1100 is shown having a string termination structure 1104 which may or may not include a bridge for the strings. This illustration also shows an open volume 1101 in which a sub-module 1102 of various types may be inserted. The submodule 1102 may or may not include a bridge for the strings, and may or may not include vibration-sensing transducers and vibration-drive transducers. These transducers and/or the bridge (which may also include a transducer) may be integrally built into the sub-module 1102, or may in turn themselves be sub-modules 1103*a*, 1103*b* that may be installed in the sub-module 1102. This arrangement may be configured so that such transducer and/or bridge sub-modules 1103*a*, 1103*b* may be installed directly (or via a mechanical adapter) into the open volume 1101.

Of demonstrable interest depicting flexibilities of the invention is the example cases where the transducers may not only be mounted in arbitrary fixed positions along the string length, but also actively movable along the string length during performance by mechanical or by electrically-controlled motorized means. These arrangements are applicable to a wide range of transducer and instrument types.

Figure 12A:
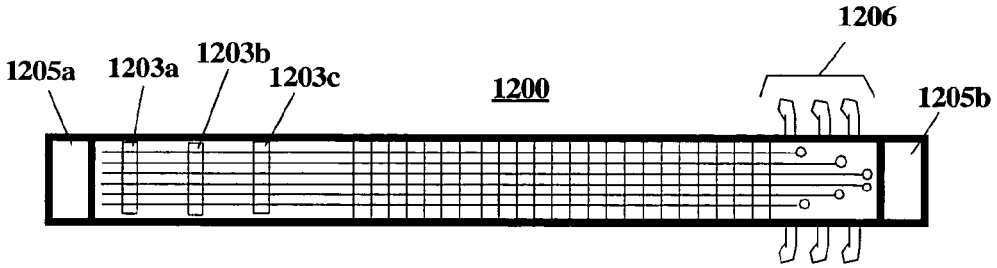
FIGS. 12*a*-12*c* show a number of exemplary configurations where an array of tuners are configured within the confines of the frame boundary.
Figure 12B:
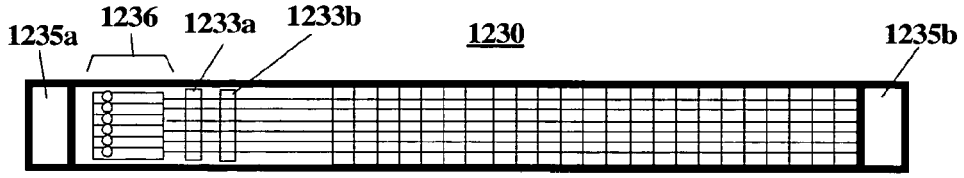
Figure 12C:
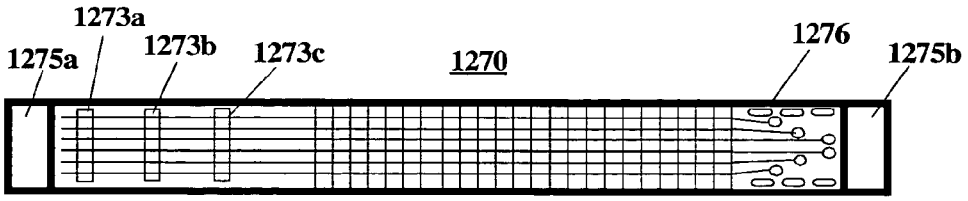

FIGS. 12*a*-12*c* show a number of exemplary configurations where the array of tuners lies within the confines of the frame boundary. FIG. 12*a* shows a stringed instrument module 1200 having the array of tuners 1206 lying between the mounting areas 1205*a*, 1205*b*. This particular configuration shows the hand adjustment keys for the tuners extending outward parallel to the plane of the instrument's neck surface, as is traditional for many electric guitars. Alternatively, these tuning keys may be configured to point outwards and backwards, orthogonal to the plane of the instrument neck surface, as is also traditional for classical guitars and some banjos. Also depicted is a bridge 1203*a* (which may include a transducer) and transducers 1203*b*, 1203*c*.

FIG. 12*b* shows a stringed instrument module 1230 with the array of screw cantilever tuners 1236 lying between the mounting areas 1235*a*, 1235*b*. This configuration the screw cantilevers tuners 1236 serve as the bridge (although other arrangements are of course possible) and the "set-screw" hand adjustment keys for the tuners extend outwards and forwards, orthogonal to the plane of the instrument neck surface as is found on some electric guitars and basses. Also depicted are transducers 1233*a*, 1233*b*.

FIG. 12*c* shows a stringed instrument module 1270 with the array of tuners 1276 lying between the mounting areas 1275*a*, 1275*b*. This configuration shows the hand adjustment keys for the tuners extending outward parallel to the plane of the instrument's neck surface, as is traditional for many electric guitars. Alternatively, these tuning keys may be configured to point outward and forward, orthogonal to the plane of the instrument neck surface. Also depicted is a bridge 1273*a* (which may include a transducer) and transducers 1273*b*, 1273*c*. In each of the configurations of FIGS. 12*a*-12*c*, it is to be understood that fewer or additional tuners and associated hand adjustment keys may be included, and in particular for double strung ("two course") instruments, tuners may be configured so that some hand adjustment keys are oriented in one direction while others are oriented in a different direction, so as to functionally utilize limited space. It is also possible to place one set of tuners at one end (such as those of 1206) of the instrument for course tuning, secure the string tension with a "locking" pinch nut, and use screw cantilever tuners (such as those of 1236) for fine tuning as made commonplace using conventional designs (specific examples being the Floyd Rose tremolo tailpiece and the tuners described in U.S. Pat. No. 4,171,661 by Rose).

Figure 13A:
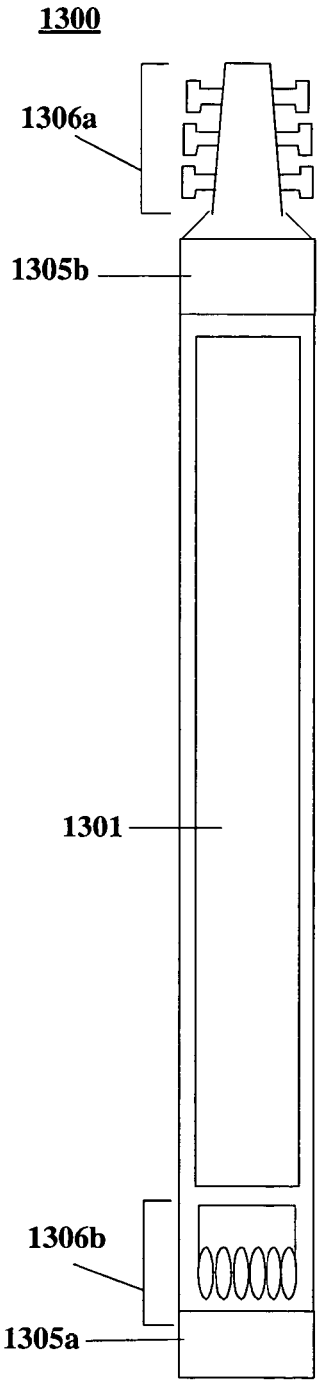
FIGS. 13*a*-13*b* depict an exemplary stringed instrument module.

Furthermore, as to the modular flexibility provided in accordance with some embodiments, FIGS. 13*a*-13*b* and 14*a*-14*i* illustrate the use of modularity in changing the character of the neck's playing surface. FIG. 13*a* shows the instrument without strings, depicting mounting areas 1305*a*, 1305*b* and, as previously-noted course tuners 1306*a* and fine tuners 1306*b*. In this example the course tuners extend beyond the confines of the frame boundary (as with the example in FIG. 11), but could alternatively be configured within the confines of the frame boundary (as in FIGS. 12*a*-12*c*). Of principal importance is the open volume 1301 which may be fitted with various modules and sub-modules. As this volume effectively comprises a considerable portion of the instrument's string length, the open volume 1301 may be fitted with not only the types of sub-modules considered earlier in conjunction with FIG. 11, but also with a number of other playing-surface neck inserts.

Figure 13B:
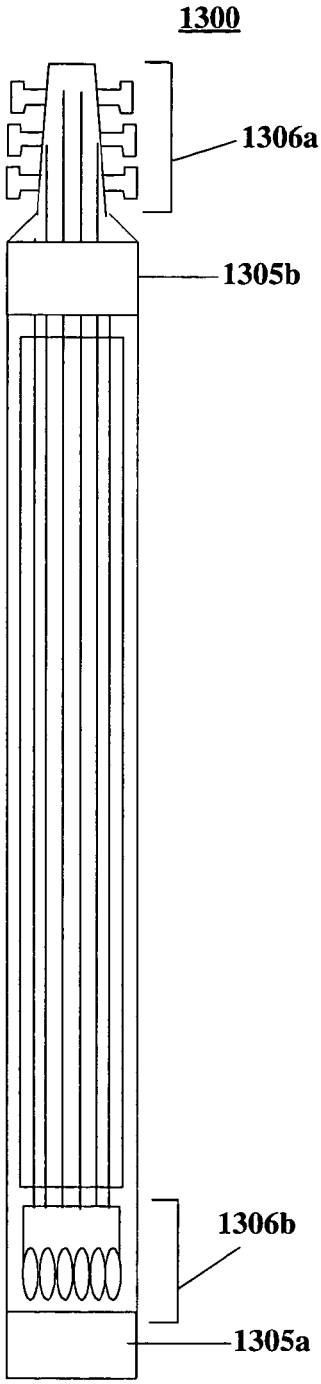

FIG. 13*b* shows the configuration of FIG. 13*a* with strings attached. Note that in this example a portion of the strings are confined within channels beneath the mounting area 1305*b*. Alternatively, the strings could be suspended over the mounting area 1305*b* with enough clearance to allow for the mounting plates (for example 500*b*, 510, 520 in FIG. 5*a*-5*f*) to be installed and removed.

Figure 14A:
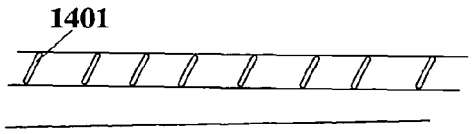
FIGS. 14*a*-14*i* depict a number of exemplary playing-surface neck inserts for installation in the more generalized stringed instrument module shown in FIGS. 13*a*-13*b;*

A number of exemplary playing-surface neck inserts for installation in the open volume 1301 are depicted in FIGS. 14*a*-14*i*. FIG. 14*a* shows an exemplary playing surface neck insert with frets 1401 suitable for guitar, fretted bass, mandolin, mandola, and other even-tempered scale instruments. Even-tempered scale instruments, such as the ones just listed, traditionally have twelve intervals per octave, but other types of scales may be used. For example, the Turkish saz traditionally uses a "quarter tone" scale with 24 intervals per octave—such a playing-surface neck insert would also resemble FIG. 14*a* but with a higher density of frets. Other implementations of playing-surface neck inserts may support non-even-tempered scales, such as intonation, mean tone, etc. For these types of scales, the frets may be non-uniformly spaced, zigzaged or even split as often found on a dulcimer (discussed below and as suggested in FIG. 14*i*).

Figure 14B:
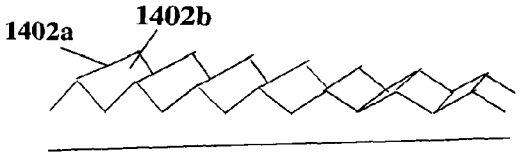

FIG. 14*b* shows a playing-surface neck insert with a fretting system similar to that traditionally employed in Asian instruments, such as the Chinese pipa. In this Figure, the frets 1402*a* are the angular edges of triangular wedges 1402*b*. This style of fret allows for the strings to be deeply displaced into the triangular cavities between adjacent frets. The resulting method of changing the string tension naturally permits a distinctive type of vibrato and pitch bend compared to the universal practice, common to almost all fretting systems, of dragging the string transversely across the fret.

Figure 14C:
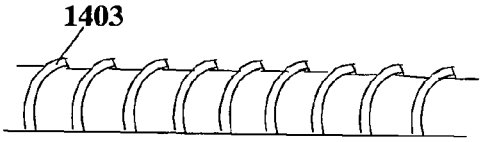

FIG. 14*c* illustrates a playing-surface neck insert featuring curved broad frets 1403 that are often used in the Indian sitar, esraj, and dilruba. This style of fret allows for the strings to be significantly displaced across the arc of the curved fret by dragging the string transversely across the fret. Here, however, a substantially longer vibrating string length is realized during string displacement due to the curvature of the fret. This configuration causes the string to enlarge, resulting in yet another dynamic of changing string tension, and naturally creating a distinctive type of vibrato and pitch bend.

Figure 14D:
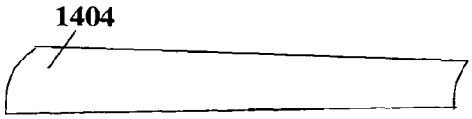

FIG. 14*d* shows a playing-surface neck insert comprised of a smooth, fretless playing-surface 1404, as may be used with a violin, cello, fretless electric bass, Turkish oud, Japanese shamisen, Korean kum, and other related instruments. The surface 1404 may be flat, slightly curved, as found on a typical electric fretless bass or shamisen, or more significantly curved, as found on a conventional violin, cello, or kum.

Figure 14E:
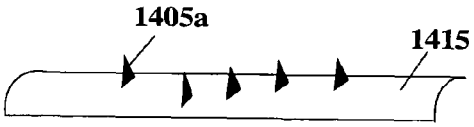

FIG. 14*e* shows a playing-surface neck insert comprised of a smooth, fretless playing-surface 1415 similar to that of FIG. 14*d*. In this figure, the neck insert includes additional raised bridges 1405*a* suspending the strings in open space as may be used with a Japanese koto, Chinese sheng (or gu zheng), Korean kayagum, Korean taejaeng, Korean ajaeng, Korean sul, and other related instruments. It is also noted that the Korean komun'go uses the koto-style bridges 1405*a* as well as high fin-like frets 1407 (to be discussed in relation to FIG. 14*g*) on the same string. The surface 1415 may be flat or curved, and in fact may be exactly that of 1404 simply supplemented with' the string-suspending bridges 1405*a*. The portion of the string on one side of its associated string-suspending bridge is plucked, while the portion on the other side of string-suspending bridge is either not touched, pushed down (to increase the string's sounding pitch), or if the string tension is low enough, pulled longitudinally to-and-fro (to both increase and decrease the string's sounding pitch). The string-suspending bridges 1405*a* may be secured to the surface 1415, but with appropriate design and string tension they are naturally held in place (even under considerable lateral disturbance) as is the tradition with these instruments. The resulting "movable" bridges not only facilitate rapid changes in open-string tuning, but traditionally rock slightly with variations in string tension, adding to the distinctive type of vibrato and pitch bend made possible by the string-suspending bridge.

Figure 14F:
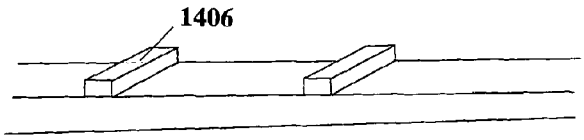

FIG. 14*f* illustrates a playing-surface neck insert featuring broad step-like frets 1406 that are commonly used in Asian instruments such as the Japanese biwa. The large gaps between the broad step-like frets permit vibrato and pitch bend not unlike that of the pipa style frets depicted in FIG. 14*b*.

Figure 14G:
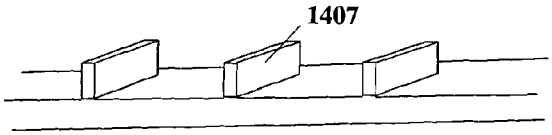

FIG. 14*g* illustrates a playing-surface neck insert featuring high fin-like frets 1407 that are often used in Asian instruments such as the Chinese ruan, Korean wolgurn, and Korean komun'go. The large gaps between the high fin-like frets permit vibrato and pitch bend not unlike that of the pipa style frets depicted in FIG. 14*b* and the biwa style frets depicted in FIG. 14*f*. It is noted that the Korean komun'go uses both the high fin-like frets 1407 and the koto-style bridges 1405*a* (of FIG. 14*e*) on the same string. Thus, in one implementation, a playing-surface neck insert such as that of FIG. 14*g* featuring high finlike frets 1407, intended for use in the context of a Chinese rum or Korean wolgum, may be further fitted with the same movable string-suspending bridges 1405*a* as depicted in FIG. 14*e* to create a Korean komun'go configuration.

Figure 14H:
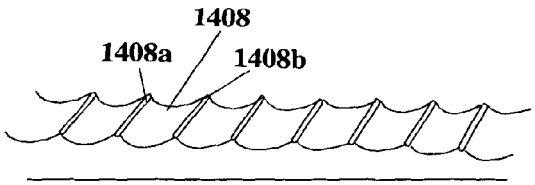

FIG. 14*h* illustrates a playing-surface neck insert featuring an escalloped neck surface area 1408 between pairs of frets 1408*a* and 1408*b*, which, similar to the pipa type neck depicted in FIG. 14*b* allow for downward pressure to be applied on the string to increase the pitch. This type of neck and fret configuration may be found in the South Indian vina, but was popularized in various forms for use with a guitar by guitarist Matthew Montfort of ensemble Ancient Future, jazz/rock guitarist John McLaughlin, and rock guitarists Yngwie Malmsteen and Ritchie Blackmore (the latter of which each have a namesake scalloped neck Stratocaster™ model manufactured by and commercially available from Fender Musical Instruments Corporation, Scottsdale, Ariz.). Typically associated with higher string tensions and purely metal strings, the resulting combination of neck configuration, string tension, and associated taunt metal string elasticity gives rise to a distinctive type of vibrato and pitch bend.

Figure 14I:
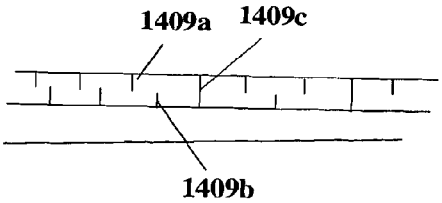

FIG. 14*i* illustrates a playing-surface neck insert featuring a neck surface 1409 fitted with a plurality of partially-spanning frets, such as 1409*a*, 1409*b*, and full-span frets, such as 1409*c*, each typically positioned in association with specifically designated scales and open string tunings. Note that in principal the use of partially spanning frets may be applied to other configurations (such as, those depicted in FIG. 14*b* and FIGS. 14*f*-14*h*).

In the various configurations described above, the playing-surface neck inserts may simply be isolated neck playing surface sub-modules or, may include appropriately configured bridges, transducers, etc.

In addition to the various types of playing-surface neck inserts described above in conjunction with FIGS. 14*a*-14*i*, it is also possible to fill the gap 1301 (see FIG. 13) with a low-cost ornamental filler block, or surface cover, or leave the gap 1301 completely open to readily realize the configurations used in a harp, zither, sympathetic string array, etc. Larger format string arrays for use as harp, zither, sympathetic string arrays, etc. may also be formed as a self-contained instrument module.

Figure 15:
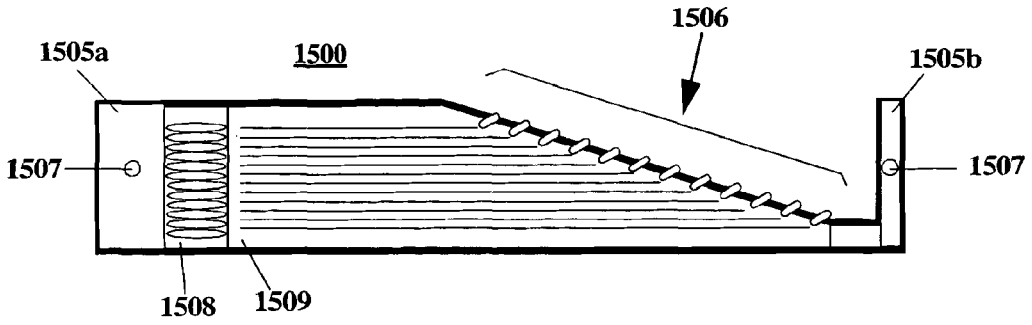
FIG. 15 shows an exemplary larger width harp or zither configuration employing a variety of sounding string lengths.

FIG. 15 shows an exemplary open gap configuration of instrument module 1500 secured to mounting areas 1505*a*, 1505*b*, a larger plurality of strings 1509 and associated tuners 1506, which are shown arranged to facilitate a spectrum of different string lengths. In this particular example, fast-adjust stepwise re-tuners 1508 (a specific example being the Trilogy™ bridge manufactured by Hipshot Products, Inc., Interlaken, N.Y.) may be added to rapidly re-adjust the pitch of selected strings as keys and scales change.

3.2 Keyboard Modules and Sub-Modules

The electronic keyboard instrument modules that have been described include the modules shown in FIG. 2*a* (217), FIG. 2*b* (261, 262), FIG. 7*g* (791), and FIG. 10*b* (1012). In general, these keyboards instrument modules may have full-sized keys or utilize miniature keys. The keyboard modules may be a holistic integrated unit or may be comprised of individual modules, each comprising a smaller number of keys. The keys themselves may be simple on/off switches, single-pole double-throw switches (as often used for gross velocity measurements), and/or comprise one or more sensors (using, for example, the sensor designs and configurations presented in U.S. Pat. No. 6,570,078), to provide additional levels of expressive control. The keyboard modules may or may not produce control signals in MIDI format, and may or may not include at least one internally housed music synthesizer. Keyboard modules that are a holistic integrated unit may also include various electronic controls, such as, for example, buttons, switches, expression wheels/levers/joysticks, sliders, knobs, etc.

3.3 Hierarchical Frames for Smaller Format Modules

Considerable description has been provided relating to instrument modules of larger size format, including FIGS. 11, 12*a*-12*c*, 13*a*-13*b*, 14*a*-14*i*, and 15, and in portions of FIG. 2*a* (211, 212, 213, 214, 217), FIG. 2*b* (261, 262, 263), FIGS. 7*e*-7*g*, FIG. 10*a* (1002), FIG. 10*b* (1012), FIG. 11, FIGS. 12*a*-12*c*, FIG. 13, and FIG. 15. However, smaller-sized modules may also be implemented, such as suggested by FIG. 2*a* (215, 216), FIG. 2*b* (271-276), and FIGS. 10*a*-10*b* (1003). With the adoption of one or more standardized sizes for smaller modules, various types of hierarchical frame arrangements for these smaller modules can be provided to hold one or more of these smaller modules in an aggregated instrument frame. Further, the aggregate instrument frame holding the hierarchical frame may also hold larger instrument modules. FIG. 10*a*-10*b* illustrated the use of a supporting bar 1005 for this purpose.

Figure 16:
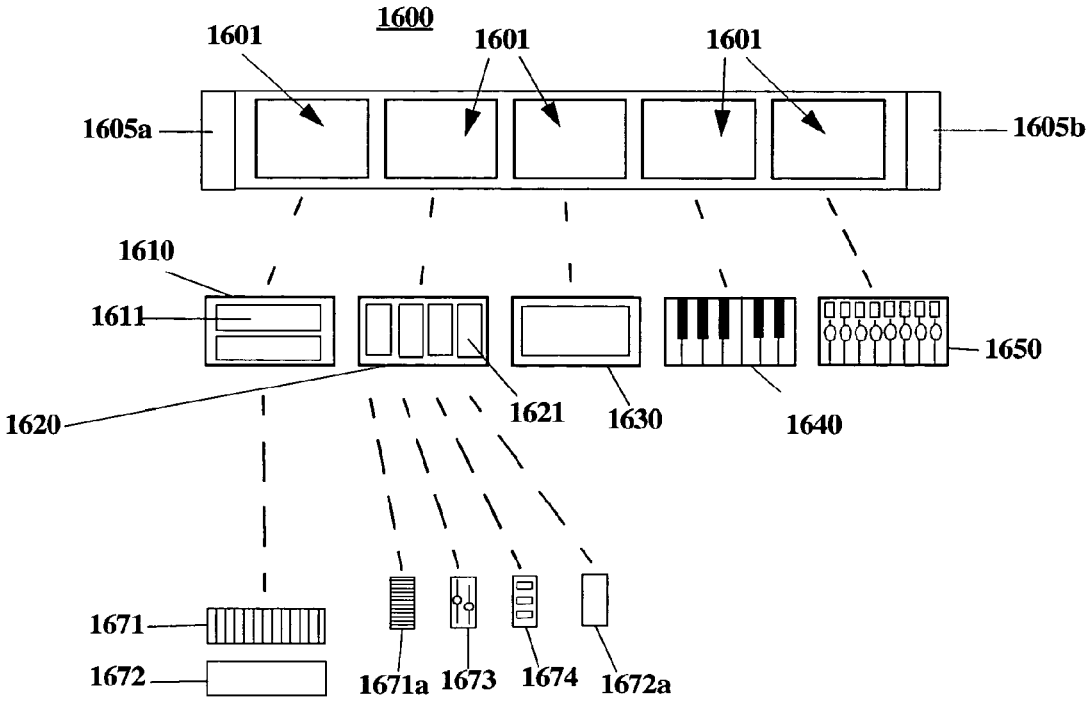
FIG. 16 shows a windowed hierarchical frame configured to externally match a larger size instrument module format and internally match a smaller sized module format with open mounting areas or volumes designed to hold one or more smaller format modules.

FIG. 16 shows another approach where a windowed hierarchical frame 1600 is configured to externally match the larger size module format, including the large format mounting areas 1605*a*, 1605*b*, and internally match the smaller sized module format with open mounting areas or volumes 1601 to hold one or more smaller format modules. FIG. 16 further shows a small format touch pad sensor module 1630 (which may be implemented using, for example, the touch pad sensor designs disclosed in U.S. Pat. No. 6,570,078), a single-octave keyboard module 1640, and a small format electronic control panel 1650 (shown featuring eight push buttons and eight slider controls). FIG. 16 also shows how this principle can be extended by including two exemplary small format second-level hierarchical windowed frames 1610, 1620. These hierarchical windowed frames may be further configured to externally match the smaller module format and internally match even smaller sized module formats employing open mounting areas or volumes 1611, 1621 to hold one or more even smaller format modules 1671, 1672 and, for example, still smaller format modules 1671*a*, 1672*a*, 1673, and 1674. In this particular example, modules 1671, 1671*a* may be strumpads, modules 1672, 1672*a* may be touch pads, module 1673 may be a pair of slider controls, and module 1674 may be a group of percussion-synthesis-controlling impact sensors. In some overall schemes, these smaller format elements may also serve as optional sub-module in other configurations. For example, stringed instrument transducer support sub-module 1102 (referring to FIG. 11) for fitting into a stringed instrument module 1100 may include one or more regions for mounting "sub-module" items such as strumpads 1671, 1671*a*, touch pads 1672, 1672*a*, sliders 1673, impact sensors 1674, chord button arrays, etc.

It is noted that the relative size and spacing configurations of the various module formats depicted in the figures is exemplary and that other configuration may be implemented as may required or desired. For example, the hierarchical frame 1600 shown in FIG. 16 comprises five open volumes 1601 of an exemplary size. Another hierarchical frame may comprise a larger or smaller number of open volumes 1601 of the same size, or of a different size profile better matching the situation of the different number of open volumes 1601.

Figure 17:
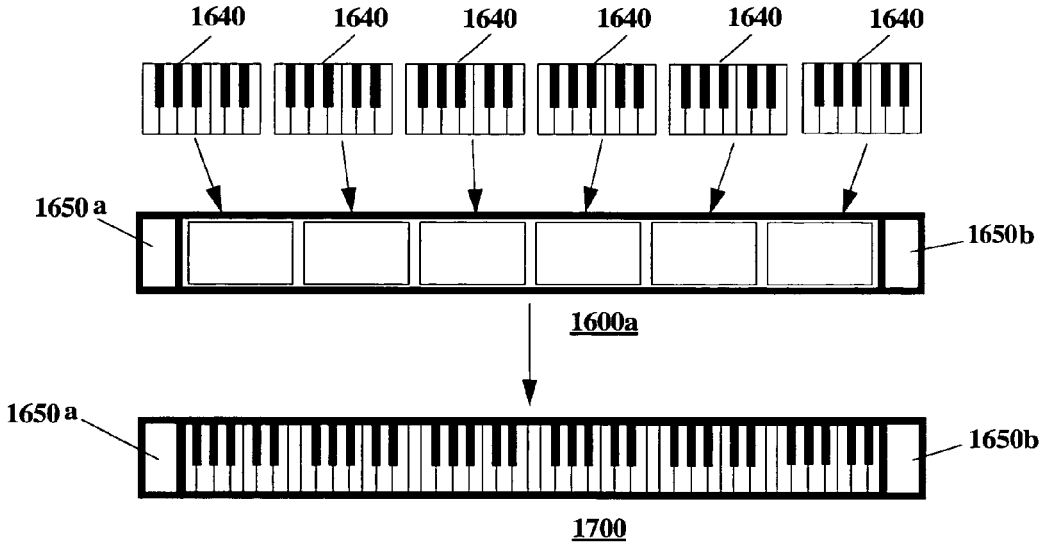
FIG. 17 illustrates how one-octave keyboard modules may be used to create a larger contiguous multi-octave keyboard.

FIG. 17 is one example of how one-octave keyboard modules may be used to create a larger contiguous multi-octave keyboard. In this figure, the hierarchical frame 1600*a* comprises six open areas, each receiving a one-octave keyboard module 1640, thus creating a larger composite contiguous multi-octave keyboard 1700. As shown, each of the exemplary one-octave keyboard modules 1640 range from "F" to "E," resulting in a "F" to "E" range for the resulting composite multi-octave keyboard 1700. Other arrangements are possible, including configurations with modules of slightly different sizes and key sequences, for example, to realize more traditional "C" to "C" multi-octave keyboard configurations.

Figure 18A:
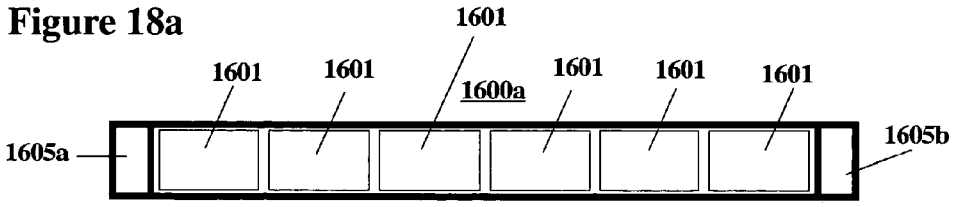
FIGS. 18*a*-18*c* illustrate how hierarchical frames allow for wide ranges of additional customization for the musician's performing, recording, or composing needs for a hand-operated instrument.
Figure 18B:
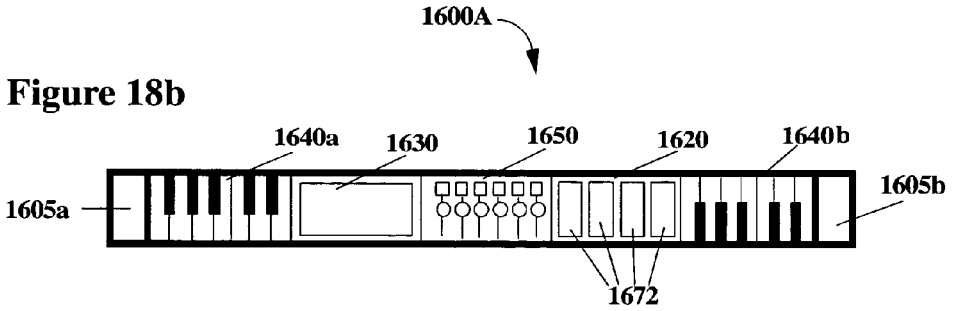
Figure 18C:
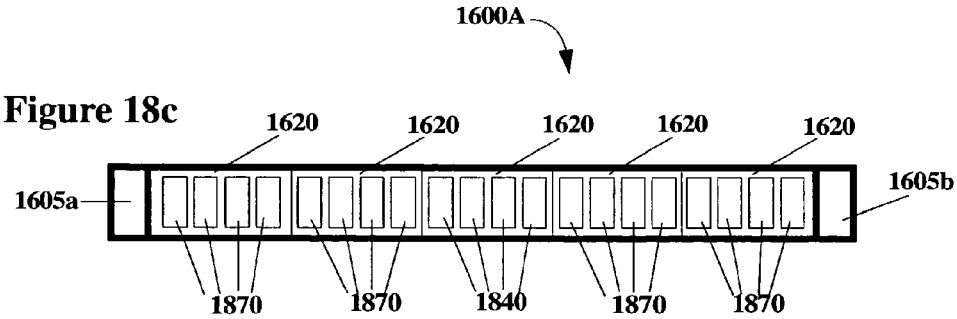

These hierarchical frames allow for wide ranges of additional customization accommodating a particular performing, recording, or composing musician's needs. Some illustrative examples from the extensive range of possibilities are shown in FIGS. 18*a*-18*c*. FIG. 18*a* shows the six "space" (here a "space" refers to an open volume 1601) hierarchical frame 1600*a*. A musician may have a very complex need in an aggregate instrument array, comparable to that depicted in FIG. 2*a*, either worn as in FIG. 3*c* or implemented using a stand support as depicted in FIG. 3*e*. This musician assembles the highly specialized hodge-podge depicted in FIG. 18*b*. The mounting areas 1605*a*, 1605*b* are secured in the mounting frame (for example FIGS. 5*a*-5*f* or 6*a*-6*b*) at the far bottom of the frame (seen closest to the floor in FIG. 3*e*), with a stringed instrument module, such as those depicted in FIG. 12*a*, immediately above it. FIG. 18*b* shows a one-octave keyboard 1640*a* and touch pad 1630, both within reach of the right hand fingers that are playing the strings so as to be operable at the same time the strings are played, or at least be immediately reachable.

On the left side, a second one-octave keyboard 1640*b* is configured to face in the opposite direction to be readily reachable and by from the left hand positioned on the stringed instrument's neck. The musician can thus access the second one-octave keyboard 1640*b* in a fashion familiar to a guitarist playing a multiple neck guitar. FIG. 18*b* also shows a set of percussion-triggering impact sensors 1672 in a second-level hierarchical frame 1620, positioned near the user's left hand playing position, but readily operable by both hands. A set of controls 1650 are readily operable by both hands and may be used for generating MIDI commands to control signal processors, synthesizer modules, lighting, etc. which can be internal or external to the aggregated instrument configuration of FIG. 18*b*.

Figure 19A:
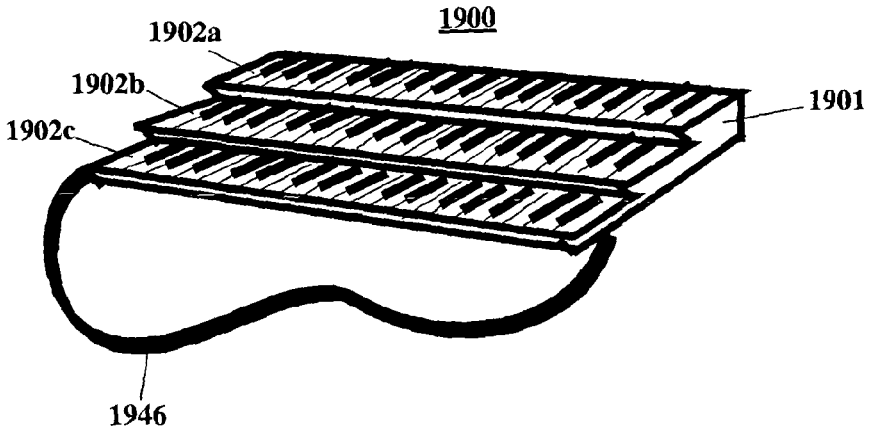
FIGS. 19*a*-19*j* depict a number of examples of purely electronic instrument aggregations (i.e., only comprising electronic instrument modules) flexibly facilitated by the invention.
Figure 19B:
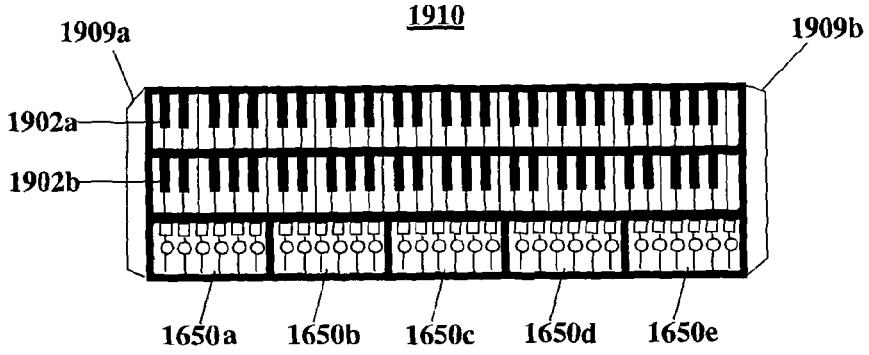
Figure 19C:
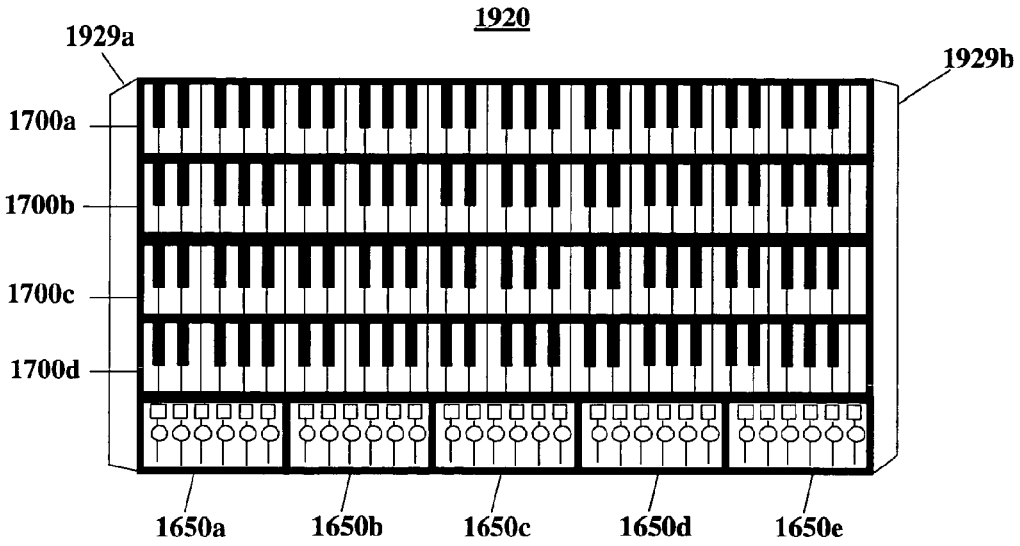

FIG. 19*c* depicts another scenario where a musician may be working with a complex set of percussion sounds and need a large array of percussion-triggering impact sensors. This musician populated the hierarchical frame 1600*a* with second-level hierarchy frames 1610 or 1620 to host a large number of impact sensor "sub-modules." FIG. 18*c* illustrates such a configuration employing hierarchical frame 1600*a*, second-level hierarchy frames 1620, and "sub-modules" 1870. For this musician, the impact sensors may be implemented using simple piezo-based sensors, similar in size to that of touch pad 1672 of FIG. 16. The arrangement of FIG. 18*c* may be used in isolation, in a self-amplified arrangement, such as shown in FIG. 10*a* or 10*b*, as part of a larger aggregated instrument of the general form seen in FIGS. 2*a*-2*b*, or as part of a much larger array of impact sensors as shown in FIG. 19*h* (here comprising four instances of the arrangement of FIG. 18*c*).

Later a musician may replace some or all of these sensor sub-modules with actual touch pad sensor "sub-modules" 1672 providing additional control to the musician by allowing control of the sound modification based on where and how the sensor is contacted during and after the impact (using, for example, the sensor designs taught in U.S. Pat. No. 6,570,078). The modularity provided for by the invention readily facilitates these types of incremental changes.

A musician may want to expand upon the general idea of the Buchla "Thunder" product (Buchla & Associates, Berkeley, Calif.) and use a configuration similar to the arrangement in FIG. 18*c*, but instead replaces sub-modules 1870 with a corresponding series of touch pad 1672 sub-modules. The three specific examples that have been described are merely representative of the many possible configurations provided for by this invention.

3.4 Electronic Control Modules and Sub-Modules

As described above, an aggregate instrument may be configured using a number of electronic control modules and sub-modules. These modules and sub-modules include, but are certainly not limited to the following, which may be provided individually or in groups:

- strumpads
- impact sensors
- pressure sensors
- null-contact touchpads
- pressure sensor array pads
- switches, multiple-position selectors, rotational or linear-motion encoders, etc.
- push buttons
- slider and knob potentiometers
- joysticks, ribbon controllers In some situations, some of these modules can be ganged together. For example, an impact or pressure sensor may be attached to the back or bottom surface of a strumpad, a null-contact touchpad, a pressure sensor array pad, or a ribbon controller, etc. The impact or pressure sensor may be actuated by impact or pressure imparted to any of the top surfaces of the later items by hand or other means. Additionally, an impact or pressure sensor may in some fashion be attached to a slider, knob, joystick, pushbutton, etc.; similarly, a pushbutton or knob potentiometer may be attached to the end handle of a joystick, etc.

Most of these individual or ganged items may serve as sub-modules, but some of these items (such as strumpads, joysticks, ribbon controllers, null-contact touchpads, and pressure sensor array pads) may also serve as modules themselves. In groups, the resulting configuration may be targeted for module or sub-module roles. The invention also provides for sub-modules to interchangeably serve as small-format instrument modules, as described in Section 3.3 above. In some implementations, it may be desirable to limit the types of electrical signal formats and protocols. In such a configuration, a simple low-cost chip with a small physical profile (for example, a surface-mount technology) may be used. A simplistic implementation could include the use of control signals in MIDI format (perhaps augmented by protocol and/or speed extensions).

3.5 Small Instrument Sub-Modules Containing Physically Vibrating Elements

In addition to the various keyboard and electronic control modules described thus far, additional variations include the use of a wide variety of small format musical instrument modules that contain physical vibrating elements. Particular examples include, but are not limited to:

- Small arrays of strings configured as miniature harps, zithers, autoharps, sympathetic strings, etc.;
- Small arrays of tynes configured as mbiras, music box sounding "combs", etc.;
- Small arrays of tuned chime bars, tuned chime tubes, tuned cymbals, etc.

In some configurations, a separate vibration-sensing transducer may be provided for each individual vibrating element to produce individual electrical signals associated with each element. This may be advantageous for a number of reasons. Separate electrical signals are typically required for meaningful conversions to control signals, such as MIDI, when employed in guitar-to-MIDI synthesizer interfaces. Additionally, separate electrical signals may be flexibly mixed to produce one or more channels of outgoing audio in fixed or time-varying proportions. One simple example of this would be to produce a stereo mix of the individual transducer signals configured to create a spatially-distributed sound field, assigning each transducer to a specific location therein. Another example would be to disable the signals associated with the vibrating elements whose pitch does not match the current chord, scale, or tonality by using techniques described in U.S. Pat. No. 6,570,078, for example.

Another valuable use of separate electrical signals is the individual signal processing of one or more selected transducer signals; for example, selected vibrating elements may be individually pitch shifted, chorused, reverbed, etc. to produce desired utility or special effects. A further use of separate electrical signals is the individual restructuring of the dynamics (via envelope generators, compressors, etc.) and/or overtone series-(via, for example, nonlinearities or overtone rearchitecting, as found in the Roland COSM technology, manufactured by Roland Corporation, Los Angeles, Calif.) of the transducer signal. Alternatively, a single vibration-sensing transducer may be utilized for a plurality of individual vibrating elements to produce a common electrical signal for the entire plurality of vibrating elements; here the plurality may be a subset of, or the full collection of, vibrating elements in the instrument module.

In addition to vibration-sensing transducers, such small format musical instrument modules may be provided with drive transducers for stimulating vibrating elements with electrical signals. The drive transducers may be used to create sympathetic vibration environments driven by arbitrary audio signals, such as those from other instrument modules within an aggregate instrument configuration. Drive transducers may also be used for the synthetic stimulation of vibrating elements within the instrument module, such as emulation of the rhythmic excitation of the strings of a South Asian tamburi as is common in raag performance tradition.

Such small format musical instrument modules may be placed in the open volume of a hierarchical frame, such as the open volume 1601 of the hierarchical frame 1600, 1600*a*. Further, such small format musical instrument modules may be positioned in an aggregate instrument configuration so that it may be readily playable by available fingers, or may be coupled acoustically to another instrument module comprising physically vibrating elements, or set in other arrangements.

3.6 Instrument Sub-Modules

A wide range of instrument sub-module types and implementations may be associated with the aggregation frame. Only a few exemplary approaches have been described, but it is to be understood that other implementations are possible. A first level of sub-modules may include signal generation or receiving items such, as the following exemplary signal generation and receiving items:

- Audio signal:
  - vibration-sensing transducers (for example, a single channel guitar pickup, hexaphonic pickup, etc.)
  - drive transducers
  - amplified speakers
- Control signal:
  - individual strumpads
  - individual impact sensors
  - individual touchpads
  - individual pressure sensor array pads
  - individual lighting elements
- Mechanical:
  - Bridges (note these could include vibration-sensing and/or drive transducers; see above)
  - Tuning apparatus
  - Playing-surface neck inserts With respect to the items requiring signal interfaces, it may be desirable to limit the types of electrical signal formats and protocols. In such a configuration, a simple low-cost chip with a small physical profile (for example, in using surface-mount technology) may be used. A simplistic implementation would include the use of control signals in MIDI format (perhaps augmented by protocol and/or speed extensions). Similarly, all audio signals from these transducers could be of a common analog format. Alternatively, and preferably, when the creation of a simple low-cost high-fidelity mixed-signal chip becomes commercially viable, all audio signals could be of a common digital audio format and protocol. The latter neatly solves the problem of multiple-channel transducers housed in a single package as the associated plurality of digital audio streams may be multiplexed together into a common electrical circuit or optical path of a physical level interface.

A second level of sub-modules may include items such as the following:

- Audio signal:
  - Transducer interface modules
  - Transducer signal processing modules
  - General audio signal processing modules
  - Audio signal mixing and switching modules
- Control signal:
  - Control panel modules (i.e., groups of controls, switches, etc.)
  - Control signal processing modules
  - General control signal processing modules
  - Control signal mixing and switching
  - Strumpads together with chord buttons (using, for example, the strumpad designs disclosed in U.S. Pat. No. 6,570,078)
- Aggregate:
  - Transducers, bridge, and transducer interface modules
  - Transducers, bridge, and transducer interface modules together with playing-surface neck inserts
  - Transducers, bridge, and transducer interface modules together with playing-surface neck inserts and tuning apparatus.

If desired, other types of controls and signals may be employed such as those for computer controls and computer data signals. It is envisioned that a second level sub-module may host open sites permitting the installation of one or more first level sub-modules, as well as the creation of sub-modules that interchangeably serve as small-format instrument modules, such as described earlier in Section 3.3.

3.7 Novelty Modules

With properly standardized mechanical, electrical, and protocol formats, novelty modules can freely evolve to include a wide variety of systems and structures. Some exemplary novelty modules may include, for example, the following:

- Lighting (directly controlled, animated pattern, multicolor, variable intensity, projection, motorized or 1ightvalvelLCD-controlled position or directionality, drum-sequencer or pitch-sequencer indication, pitch-event indication, amplitude-event indication, controller-event indication, overtone-event indication) using, for example, the techniques disclosed in U.S. Pat. No. 6,610,917;
- Video camera (fixed or motorized position; fixed, motorized, or DSP-synthesized optics, etc. for general image capture, as a controller, or as an instrument (using, for example, the techniques disclosed in U.S. Pat. No. 6,570,078);
- Visual display (video, computer VGA/XGA, custom pattern generating LCD, motion or still-image projection, etc.);
- Special effects (fog issuance, bubbling or swirling fluids, electrical discharge, etc.);
- Chemical reaction vessels (using, for example, the techniques disclosed in U.S. Pat. No. 6,610,917);
- Computer interface (trackball, joystick, ASCII keyboard, specialized computer-game controllers, etc.).

Novelty modules may be implemented using full-sized instrument module formats, smaller formats, and/or sub-module formats. In addition, the smaller format novelty modules may interchangeably serve as sub-modules, as described in Section 3.3.

4. Additional Illustrative Example Configurations

Thus far it is clear that a wide range of modular and aggregated instrument types and implementations may be implemented with the aggregation frame. Some additional examples of these will now be described.

4.1 Aggregate Instrument Configurations with Purely Electronic Instrument Modules and Size Variations The various exemplary aggregate instrument configurations discussed up to this point have largely included at least one instrument module comprising vibrating elements (e.g., vibrating strings), and many have included a mix of such vibrating element instrument modules and purely electronic instrument modules such as keyboards, touchpads, controls (buttons, switches, sliders, etc.), and the like. FIGS. 19*a*-19*j* depict a number of exemplary configurations of purely electronic instrument aggregations (i.e., those comprising only electronic instrument modules).

FIG. 19*a* shows a moderately large "wearable" multiple keyboard instrument aggregation 1900 comprising three keyboard modules 1902*a*, 1902*b*, 1903*c* coupled to a staircase frame 1901 of sleek austere profile supported by an optional, flexible shoulder strap 1946. Some or all of the keyboard modules 1902*a*, 1902*b*, 1903*c* may be configured as a contiguous holistic module, or be constructed from a hierarchical frame 1600*a* having a number of small-format keyboard modules 1640 to form a composite module 1700 as shown in FIG. 17.

FIG. 19*b* depicts an exemplary variation 1910 of the instrument aggregation of FIG. 19*a*. Specifically, FIG. 19*b* shows instrument aggregation 1910 where the keyboard module

1902*c* has been replaced with a 5-opening hierarchical frame 1600 (obfuscated in this figure) filled with a number of small-format electronic control modules 1650*a*-1650*e*, and where the sleek profile staircase frame 1901 has either been fitted with endcaps or replaced altogether to form the ornamental arrangement 1909*a*, 1909*b*. The electronic control modules may be used to control aspects of the sounds created by the keyboards, or they may be used to control the creation of other sounds or other equipment (for example, external lighting). It is noted that the frame in either of these arrangements, as well as the others in this section, need not be of staircase form—indeed they may be coplanar/flat, curved, etc. It should also be realized that strap 1946 in FIG. 19*a* is not required; the exemplary arrangements in this section may be implemented using any suitable support mechanism or device, including the techniques depicted in FIG. 3*a* and FIG. 3*d*.

Continuing with the gallery of exemplary illustrations, FIG. 19*c* shows a larger format version 1920, adding an additional keyboard to the arrangement 1910 of FIG. 19*b*, and secured by ornamental frames or endcaps 1929*a*, 1929*b*. In practice, a wearable keyboard could readily include as many as five keyboards arranged in this fashion, particularly if miniature keyboards are used. In FIG. 19*c*, the keyboards 1700*a*-1700*d* may each be implemented using the hierarchically-constructed composite module 1700 depicted in FIG. 17.

Figure 19D:
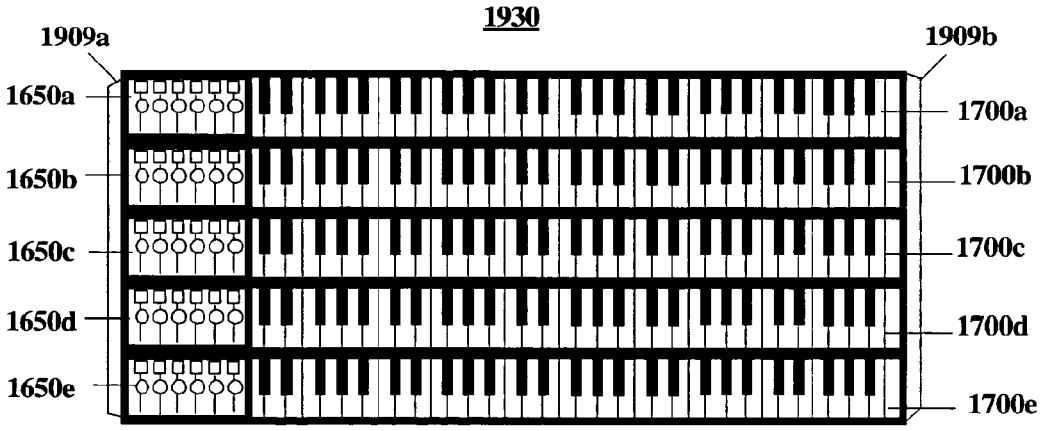

FIG. 19*d* illustrates another exemplary arrangement 1930 where the electronic control modules 1650*a*-1650*e* are positioned on the side of the keyboards 1700*a*-1700*e*. In one realization of this configuration, the underlying frame holding keyboards 1700*a*-1700*e* may be wider than those described above to provide an extra open volume for mounting the electronic control modules 1650*a*-1650*e* (for example, permitting electronic control modules 1650*a* to be put on one side of the same hierarchical frame 1700*a*. In another realization of this configuration, the size of the underlying frame may be the same or similar to the frame size utilized in the embodiments depicted in FIGS. 19*a*-19, but in this case the keyboards 1700*a*-1700*e* are miniature keyboards. Again, ornamental frames or endcaps 1929*a*, 1929*b* are shown, but other frame profile arrangements, such as those depicted in FIG. 19*a*, may be used.

Figure 19E:
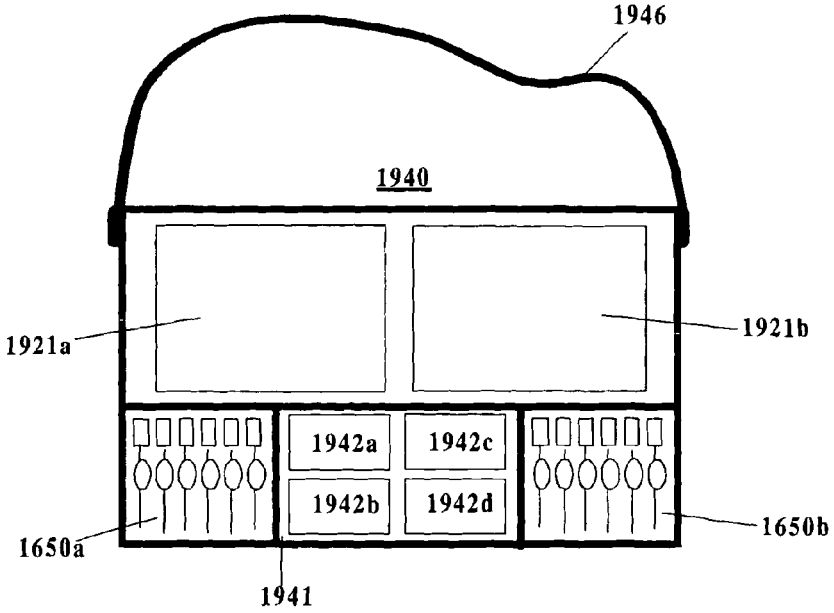
Figure 19F:
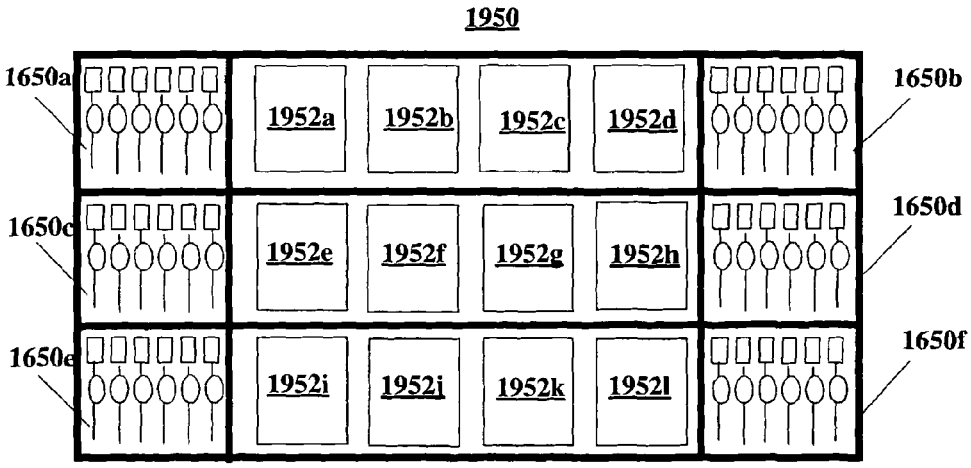

FIGS. 19*e* and 19*f* illustrate electronic controller module aggregations that implement non-keyboard instrument modules. In general, the various individual modules may be used to control music synthesizers, sample players, lighting, signal processing, etc. When used to control music synthesizers or sample players, these arrangements may be used for electronic percussion or musical timbre "finger painting."

FIG. 19*e* begins this sequence with a small format configuration 1940 configured using shorter hierarchical frames. One of these shorter hierarchical frames has two open volumes in which two touchpads or pressure sensor array pads 1921*a*, 1921*b* have been mounted or otherwise secured. The other frame is shown having three openings. In one of these openings, two of the electronic control modules 1650*a*, 1650*b* have been mounted. The third opening has a smaller hierarchical frame 1941, which may be the same or similar size as the electronic control modules 1650*a*, 1650*b*. The smaller hierarchical frame 1941 is shown configured with four openings for smaller touchpads, smaller pressure sensors, impact sensors, lights, etc. 1942*a*-1942*d*. The configuration of FIG. 19*e* is also depicted with an optional, flexible shoulder strap 1946.

The exemplary configuration depicted in FIG. 19*f* returns to the use of the 6-opening hierarchical frame 1600*a* (as shown in FIG. 17). However, the configuration 1950 is shown having three such 6-opening hierarchical frames. The outer portions of each of the hierarchical frames have two mounted electronic control modules (1650*a*, 1650*b* top; 1650*c*, 1650*d* middle; 1650*e*, 1650*f* bottom). The center four openings of each of the hierarchical frames host touchpads, smaller pressure sensors, impact sensors, lights, etc. (1952*a*-1952*d*; top; 1952*e*-1952*h* middle; 1952*i*-1952*l* bottom).

Figure 19G:
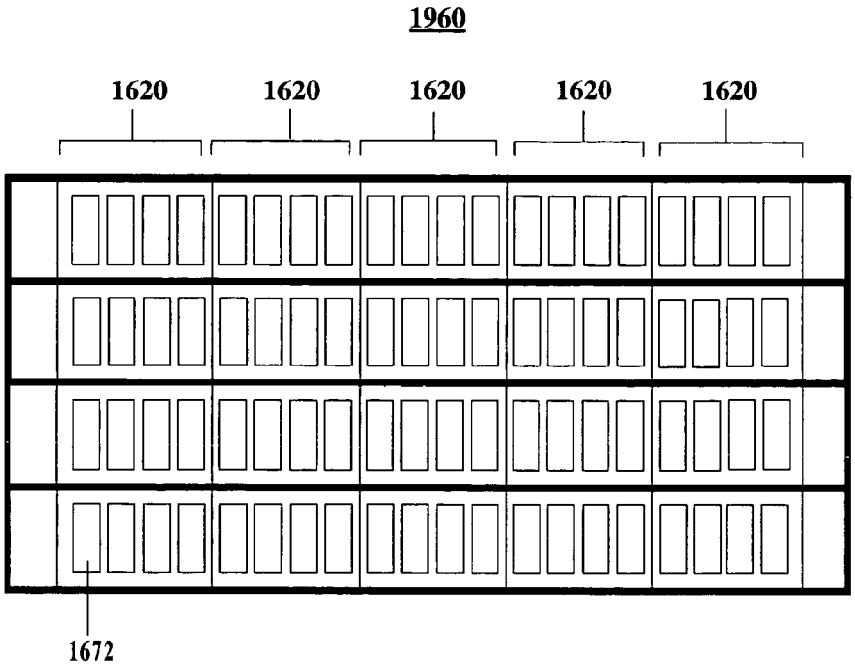
Figure 19H:
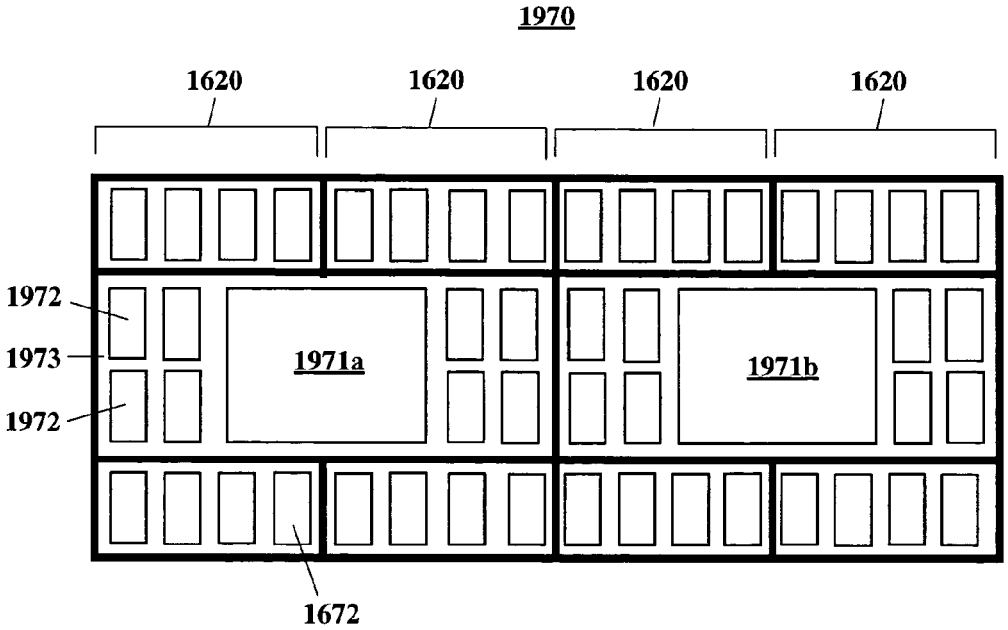

The exemplary configuration 1960 depicted in FIG. 19*g* illustrates another application of the 5-opening hierarchical frame. Configuration 1960 is shown with a series of smaller hierarchical frames 1620 which are each configured with a plurality of submodules 1672, which may be touchpads (or smaller pressure sensors, impact sensors, lights, etc.). Such a configuration may be particularly useful as a percussion or lighting controller and, as again with all the configurations described herein, may be worn with a flexible shoulder strap supported by a floor or table stand (not shown in this figure), placed upon a support structure such as a table, or simply held by the user.

The exemplary configuration 1970 depicted in FIG. 19*h* shows the use of other hierarchical frame formats and matching modules. In this example, the hierarchical frames may be roughly ⅔ the length of the standard size associated with the stringed instrument modules, such as those depicted in FIGS. 12*a*-12*c*, and may comprise a smaller number of standard size openings. FIG. 19*h* depicts two of the three shorter hierarchical frames fitted with a smaller hierarchical frame 1620, which in turn is fully populated with sub-modules 1672 that may also be impact sensors (or small touchpads, small pressure sensors, lights, etc.). The shorter hierarchical frame, of this illustrative example, is shown mounted in the vertical center of the overall arrangement 1970 of a double-width format, and has two larger openings accepting two double-width, double-length smaller format modules 1973. In one arrangement, these double-width double-length smaller format modules 1973 are self-contained. In another arrangement, these double-width double-length smaller format modules 1973 are themselves double-width double-length hierarchical frames, with respect to the smaller format size. FIG. 19*h* shows each of these frames identically populated with a central touchpad, pressure sensor array, etc. 1971*a*, 1972*b* and eight sub-modules 1672 which may be impact sensors, small touchpads, small pressure sensors, lights, etc., arranged in two 2-by-2 arrays. The overall configuration 1970 may be particularly useful as a percussion controller.

Figure 19I:
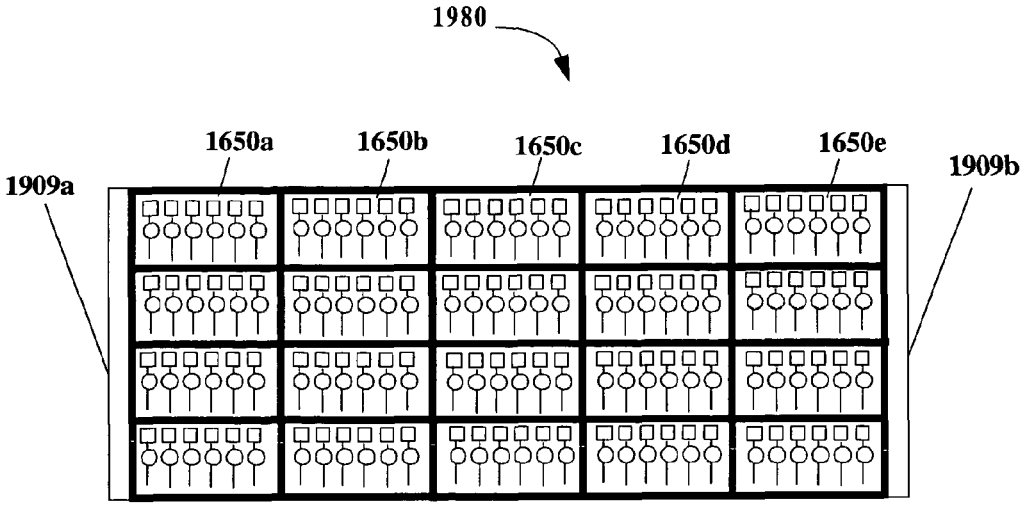
Figure 19J:
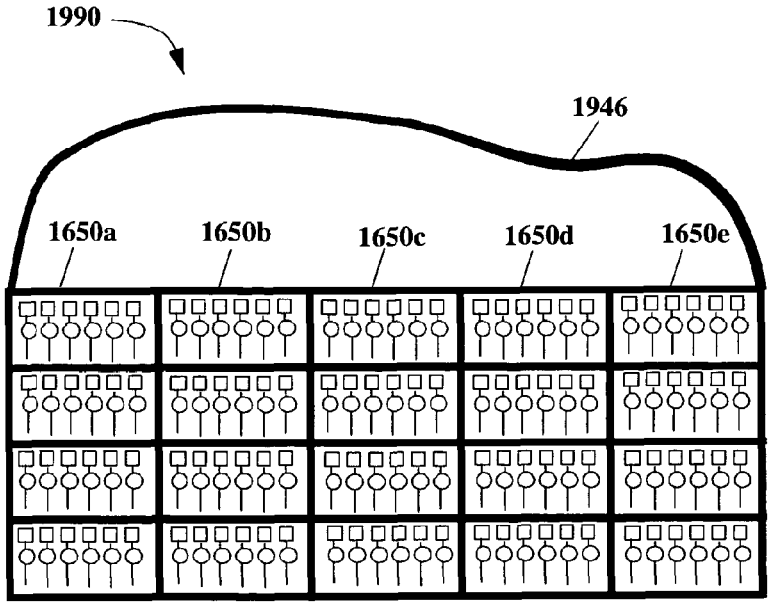

Completing this gallery of illustrations of electronic instrument module configurations, FIGS. 19*i* and 19*j* respectively show arrangements 1980, 1990 that are functionally large control panels. In more detail, arrangements 1980, 1990 each comprise four separate, 5-opening hierarchical frames where each of the openings are populated with electronic control module 1650, shown in the first row as 1650*a*-1650*e*. Configuration 1980 of FIG. 19*i* shows the use of ornamental frames or endcaps 1909*a*, 1909*b*, and an optional, flexible shoulder strap 1946.

It is to be understood that many possible configurations, variations, approaches to standards, and standardized methods for transcending the standards (as with the hierarchical frames of reduced width, longer width, and double-width double-length) are possible.

4.2 Realizing Functional Aspects of the Highly Specialized Instruments of Harry Partch Next the rich flexibility, extensible value, and artistic implications provided for by the invention are further illustrated by recasting notable aspects of the majestic instruments and musicology of American Composer Harry Partch (1901-1974).

Partch created a new world of 43 note-per-octave scales of integer-ratio relative pitches, and a large varied ensemble of instruments to render them in a wide range of timbres and dynamics. These instruments brought astonishing compositional aspects and possibilities to light, as showcased in his masterwork "Delusion of The Fury." However, only a select few musicians can access these instruments since they were never commercially manufactured. Further, it is arguably that these instruments may never become commercially viable to commercially manufacture in the absence of some interest provoking occurrence. As a result, much of the Partch musical world and endeavor is likely to remain indefinitely isolated from new musicians.

Many of the more sophisticated available music synthesizers provide support for at least some types of microtonal scales. In principle, these could be adapted to the Partch scales, and in fact some of the original Partch instruments were adapted retuned reed organs (with a highly physically-adapted traditional Western keyboard featuring staggeredly-layered keys. However, with so many notes-per-octave, and an odd-number (43) of divisions at that, correspondences of the complete Partch scale with traditional (even-number of divisions) 12-key-per-octave Western keyboard without extensive physical modification is extensively problematic. In many of his instruments (including his adapted Western keyboards), Partch addressed this matter through the use of two-dimensional tonal layouts with his instruments' playing areas (which were usually part of the vibrating elements themselves), as in the Diamond Marimba, Quadrangularis Reversum, and other Partch instruments to be discussed. In many of these instruments, the two dimensional arrangement reflects the components of the numerical pitch scaling fraction relating the sounding pitch of a given element to the fundamental pitch of the scale; i.e., numerators of the fraction sequence increase in one layout dimension and denominators sequentially increase in the other layout dimension. A very few MIDI-based controllers, such as the ZBOARD, GBOARD, AND MAGNATAR 1223 by STARR SWITCH (Starr Switch Company, San Diego, Calif.), offer a two dimensional array of buttons, and some multiple element percussion controllers such as the Roland "Octapad" (Roland Corporation U.S., Los Angeles, Calif.) and Simmons "Turtle Trap" (Simmons, West Hills, Calif.) offer small two-dimensional arrays of percussive pads, but no straight-forward way to aggregate these. In contrast, the Partch stringed instrument configurations are essentially unsupportable with available products without extensive customized construction.

Figure 20A:
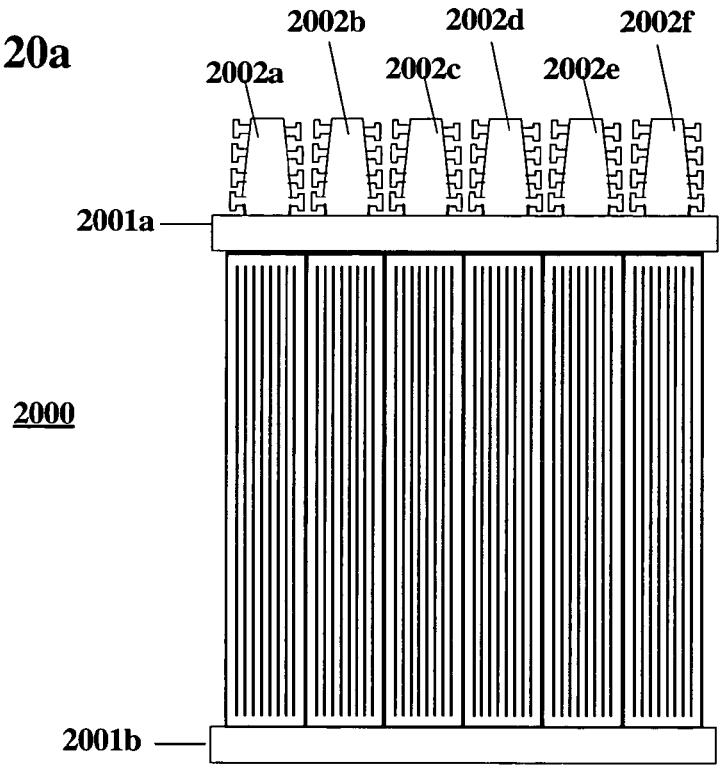
FIGS. 20*a*-20*b* depict exemplary applications of the invention to the implementation of key functional aspects of two stringed instruments of Harry Partch (the "Harmonic Cannon" and "Kithara")

Embodiments that have been described provide, among other things, flexible elements that may be readily assembled into functional replicas of key aspects of Partch instruments. FIG. 20*a* shows one implementation of a plurality of unfretted stringed instrument models 2002*a*-2002*f* mounted or otherwise secured in a common mounting frame to create an adaptation 2000 of the Partch "Harmonic Cannon" (H. Partch, *Genesis of a Music*, Da Capo Press, New York, 2nd ed, 1974, pp. 235-249).

Figure 20B:
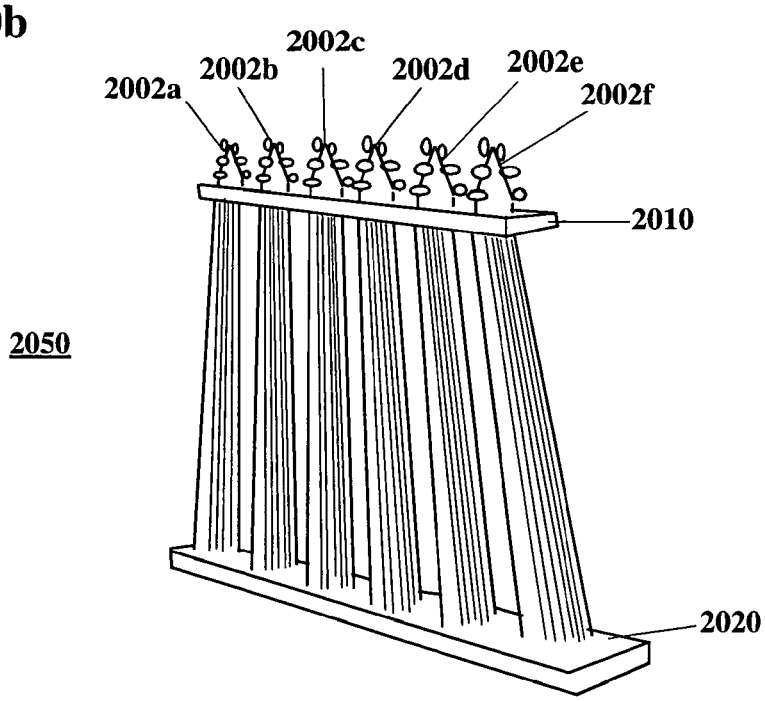

FIG. 20*b* shows the same collection of stringed instrument modules 2002*a*-2002*f* arranged in a "stacked" sequence to create an adaptation 2050 of the 72 string "Kithara" (ibid, pp. 200-231). In this configuration, the mounting straps 2001, 2201*b* of FIG. 20*a* are not used; rather the stringed instrument modules 2002*a*-2002*f* are, for example, secured in a specialize frame involving a base 2020 and upper portion 2010, both readily made from wood, Plexiglas, or other suitable material. Alternatively, an adaptation could be made of an appropriate multi-guitar stand, such as the Fender Case Stand™ (Fender Musical Instruments Corporation, Scottsdale, Ariz.) or the 7-space Warwick Rockstand (Musicican7s Friend, Medford, Oreg.).

Figure 21A:
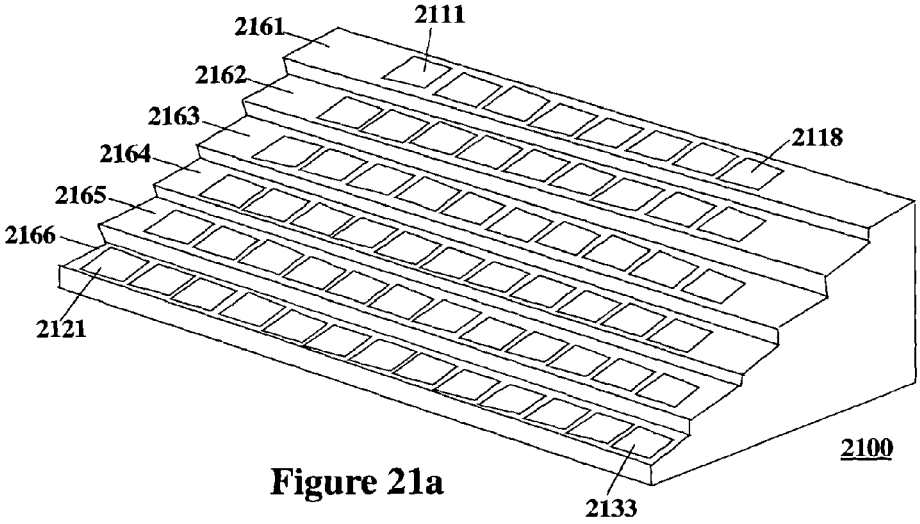
FIGS. 21*a*-21*b* depict further exemplary applications of the invention to the implementation of key functional aspects of the "Boo" percussion instrument of Harry Partch.
Figure 21B:
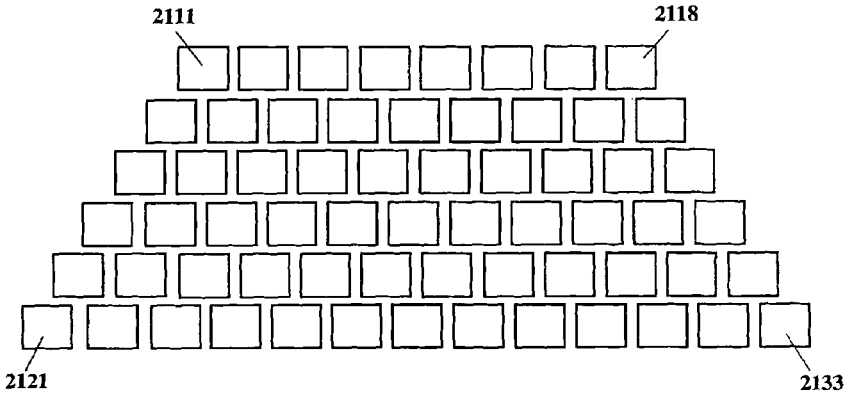

FIG. 21*a* shows the use of six tiers of hierarchical frames 2161-2166 of at least two spacing styles arranged in a staircase frame and populated with impact sensors 2111, 2118, 2121, 2133 and others to form a functional adaptation 2100 of the Partch "Boo" (H. Partch, *Genesis of a Music*, Da Capo Press, New York, 1974, pp. 282-292). FIG. 21*b* shows an idealized top view of the arrangement 2100. The impact sensor pads are arranged in the expanding pattern and are geometrically positioned to correspond with the tops of the mallet-struck bamboo tube surfaces in keeping with the original Partch instrument. The hierarchical frame may be a standard manufactured item, or readily fashioned using a suitable material such as wood, Plexiglas, etc. The impact pads are shown formed as precise rectangles, but other shapes are possible, such as the slightly irregular polygon pads 2118 and 2121. This type of stylizing may be realized in the mounting and supporting hierarchical frames 2161-2166 themselves or by means of an overlay bezel.

5. Application to Floor Controllers

A variety of hand-operated instruments have been described, and the principles and techniques that have been disclosed apply equally to other types of instruments. A particular example may be the application of these principles and techniques to floor controller devices. Particular examples of suitable floor controller devices are presented in U.S. Patent Application 2002/0005111. Employing the notions of formalized modules, mounting frames, and hierarchical frames to floor controllers, a wide range of floor controller types may be implemented using a given aggregation frame. Only a few illustrative approaches are described, but those of ordinarily skill will appreciate that a vast assortment of variations are possible within the teachings of the invention.

Figure 22A:
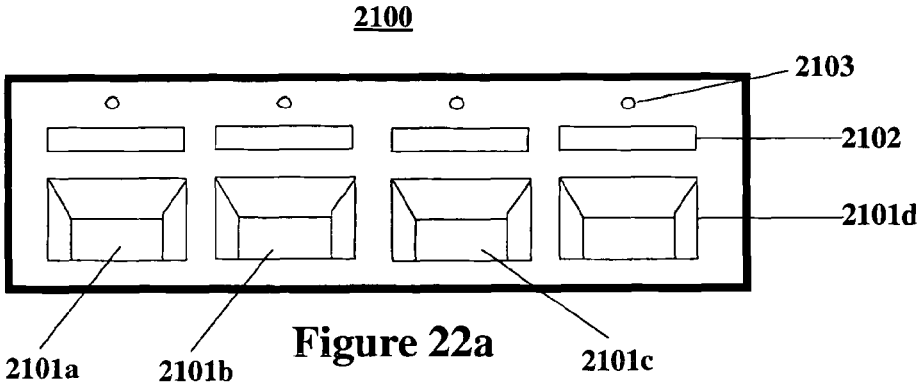
FIG. 22*a*-22*d* illustrate exemplary modules useful in demonstrating the principles of the invention as applied to floor controllers.
Figure 22B:
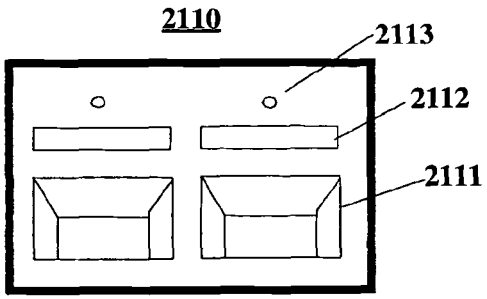

FIGS. 22*a*-22*d* depict a few exemplary modules that are possible in implementing a floor controller. FIG. 22*a* shows a footswitch controller module 2100 comprising four footswitches 2101*a*-2101*d*. Visual status and context indicators may be incorporated in a number of ways; here, for the sake of illustration, active-status LEDs 2103 are provided for each footswitch, and dedicated alphanumeric displays 2102 are provided for each footswitch. It is to be understood that either of these visual indications may be omitted, and that one or both may be incorporated in other manners (for example, LEDs may be implemented into the footswitches 2101*a*-2101*d* themselves, alphanumeric information for each footswitch may be consolidated into a single, larger multiple-line alphanumeric display shared by a group of footswitches, etc.). For the sake of illustration, a smaller two-footswitch version 2110 of 2100 is also provided for consideration; this will have utility when the total footswitch counts are preferably between two integer-multiples of four, in filling available open areas in a hierarchical frame, etc.

Figure 22C:
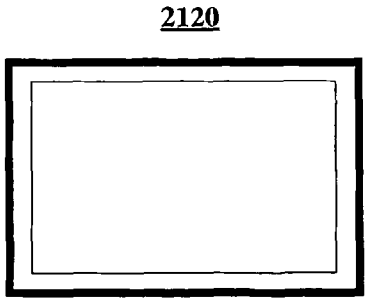

FIG. 22*c* shows a touchpad or pressure sensor array pad configured for operation by a user's foot. In principle the same touchpad or pressure sensor array pad hardware described earlier for hand operation may also be used for foot operation. However a mode change (from "hand" to "foot") in pattern recognition and parameter extraction may be advantageous, but not necessarily required for useful operation. As with the hand-operated configurations described earlier, the pad may be fitted with an impact sensor for supporting percussion applicants. In this illustration it is assumed that visual status and context indications are incorporated into the pad itself, using a transparent pad and underlying visual display. However, other arrangements or omissions of these are of course possible. The transparent pad and associated underlying visual display may be implemented using conventional techniques, such as those disclosed in U.S. Patent Application 2002/0005111.

Figure 22D:
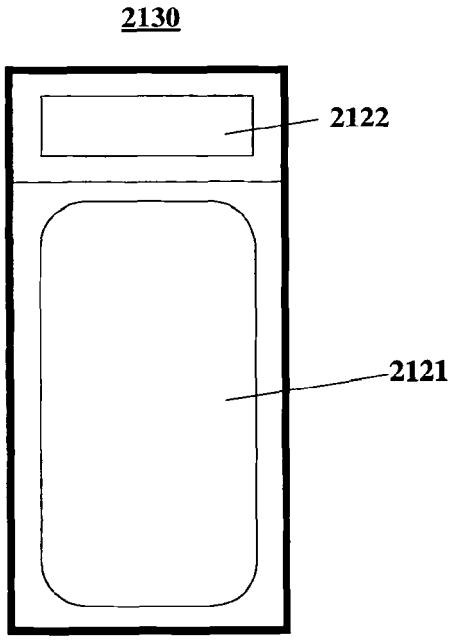

FIG. 22*d* illustrates a rocking foot pedal module 2130 comprising a rocking foot pedal 2121, again, with exemplary visual indication provided by optional alphanumeric display 2122 (or other suitable display device). The rocking foot pedal module 2130 width may be kept narrow, or widened enough to allow other degrees of motion, such as pivoting rotation. Such additional degrees of motion and/or the addition of other structures can be used to obtain greater parameters of control with a common pedal (examples of such techniques may be found in U.S. Patent Application 2002/0005111). Thus, a common module size and format of rocking foot pedal module 2130 may serve as a simple rocking foot pedal 2121 and a variety of multiple parameter foot pedals for both varying styles and complexities. Note the modules shown in these figures are purely exemplary—other possibilities may include foot-operated strumpads, individual foot-operated impact sensors, Western pipe-organ style bass pedal board pedals, etc.

Further to the example of FIG. 22*d*, the common module size and format of 2130 may be scaled together with the other exemplary modules 2100, 2110, and 2120:

Two-footswitch module 2110, pad module 2120, and foot pedal module 2130 are all the same length and half the length of four-footswitch module 2100.

Two-footswitch module 2110, pad module 2120, and four-footswitch module 2100 are all the same width and half the width of foot pedal module 2130.

Figure 23A:
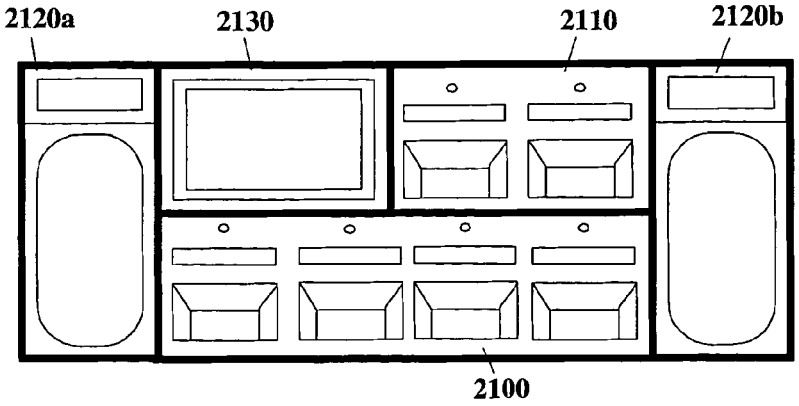
FIGS. 23*a*-23*c* illustrate an evolving heterogeneous aggregation of the floor controller modules of FIGS. 22*a*-22*d*, and specifically how hierarchical frames allow wide ranges of additional customization around a musician's performing, recording, or composing floor controller needs.
Figure 23B:
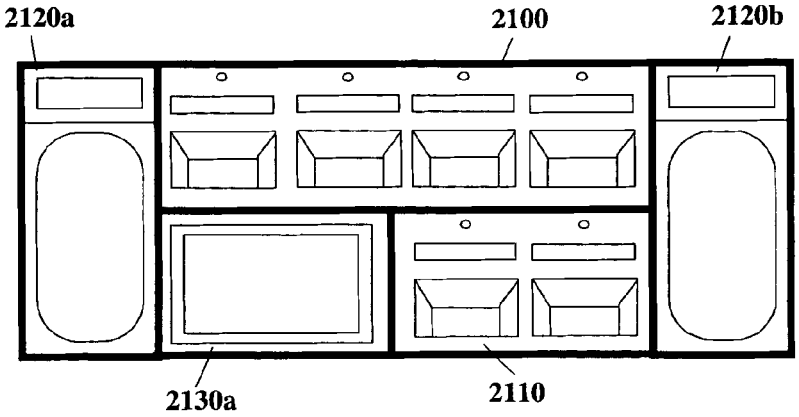
Figure 23C:
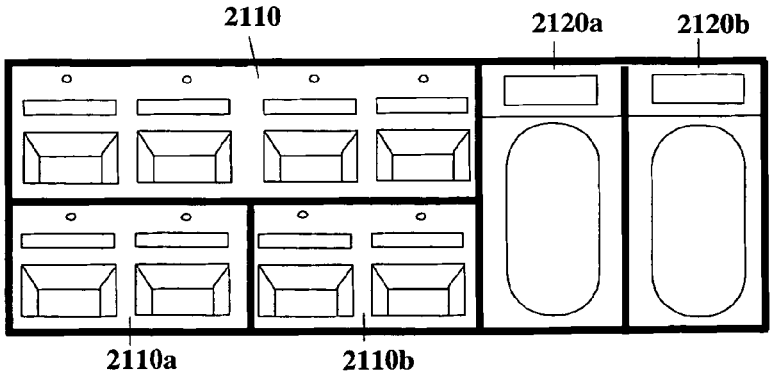

Employing this dimensioning scheme, FIGS. 23*a*-23*c* illustrate an evolving heterogeneous aggregation of the floor controller modules of FIGS. 22*a*-22*d*. For example, the configuration of FIG. 23*a* shows a pair of foot pedal modules 2130*a*, 2130*b* at either end of a mounting frame. Using hierarchical fiames or other techniques, the configuration of FIG. 23*a* may also include a four-footswitch module 2100, a two-footswitch module 2110, and a pad module 2130. The musician initially employs a simple pad module comprising a contact-null pad with a common underlying pressure sensor as a two-dimensional controller (via toe-pointing) and as a toe-pressure sensor, employing these two modalities selectively or simultaneously. Later the musician may expand the detail and nuance of a musical composition that uses the pad module 2130 by upgrading to a pressure sensor array pad module 2130*a* to control six parameters simultaneously using known techniques, such as those described in U.S. Patent Application 2002/0005111.

Figure 24A:
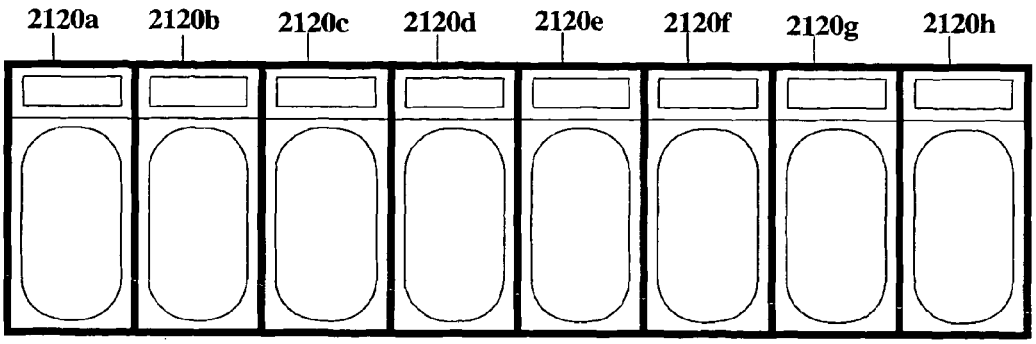
FIGS. 24*a*-24*b* depict an initially homogenous single-level aggregation of the floor controller modules evolving into a heterogeneous two-level aggregation of the floor controller modules.
Figure 24B:
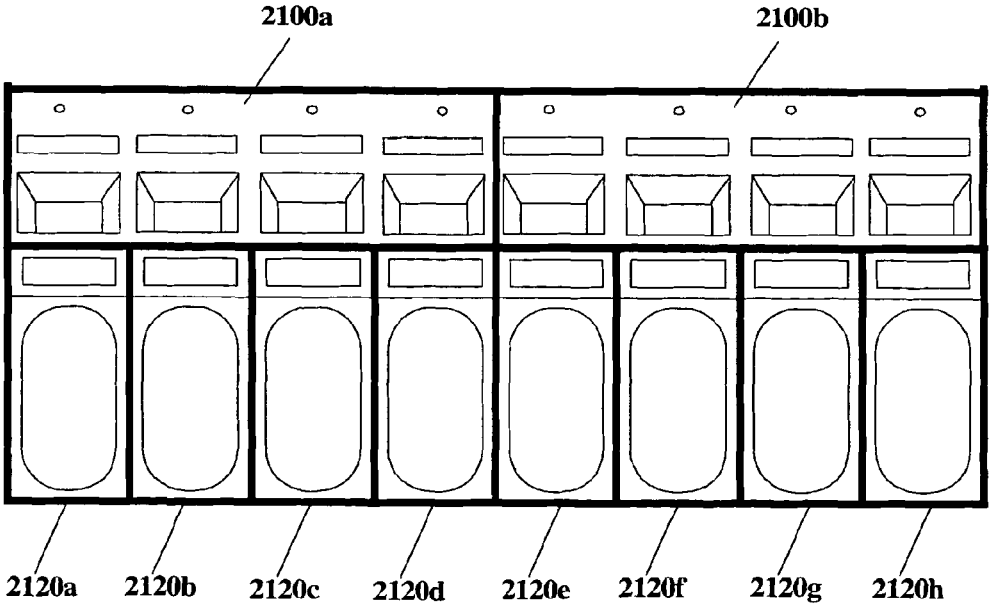

Composing now done, the musician may find that during recording it would be advantageous to restructure the configuration of the pad by moving it closer to the foot's normal standing position and moving the modules around to result in the configuration of FIG. 23*b*. Continuing with this scenario, a CD containing the recording may be later released to great acclaim for its sensitive solo rendered with the pressure sensor array pad module 2130*a* and so the musician may go on tour. Once on tour the musician finds the deafening crowd noise drowns out all those careful subtleties made available by the pressure sensor array pad module 2130*a*, and furthermore that in the excitement and nervousness of playing in venues before large noisy audiences of screaming high-energy fans with flowers (and other objects) being thrown on stage, there is at times trouble concentrating enough to use the pressure sensor array pad module 2130*a* as well as it was done in the now famous recording. The musician reviews the solo and artistically decides to instead simply use one of the foot pedals 2120*a* or 2120*b* to create an easy-to-operate one-parameter variation over time with a simple foot motion and derive a plurality of control signals from that one=parameter foot pedal control signal (using, for example, the control signal processing techniques presented in U.S. Pat. No. 6,570,078) to produce a net effect that sounds "close enough" to the now famous recording on the musician's CD. Not needing the pressure sensor array pad module 2130*a* any more on this tour, the musician simply replaces it with another two-footswitch module 2110*a*, for example, which finds immediate applicability in controlling a recently added on-instrument miniature fog-generation machine while performing. Later the musician finds a preference to use right same foot for both foot pedals so the unit is finally reconfigured with foot pedal 2120*a* now moved to the right next to foot pedal 2120*b*. The fortune and perils of a musician's career have been improved in all phases by the principles of the invention. Two other exemplary configurations are now considered. FIG. 24*a* shows an aggregation of eight of the same type of modules, and in particular, foot pedal modules 2120*a*-2120*h*. This results in an eight rocker-pedal floor controller which may be used for controlling a synthesizer, signal processing parameters, 3D-sound localization, lighting, etc., by another musician. This configuration is originally assembled as a flat layer, but later the musician may need to support a wider range of usage contexts for the group of pedals requiring footswitches. A staircase frame may be used to position two four-footswitch modules 2100*a*, 2100*b* on a raised upper deck to control the contexts and settings of the group of foot pedal modules 2120*a*-2120*h*, as shown in FIG. 24*b*.

6. Standardizations, Multi-Vendor Manufacturing, and the Evolution of Instruments and their Commercial Markets As seen from the discussions above, the invention provides for a wide range of opportunities for multiple-vendor standardizations, multiple-vendor manufacturing, multiple-vendor competitive features, etc., while offering the music equipment user and the music industry as a whole, access to a spectacular range of instrument customization, diversification, and education. Only a few exemplary approaches are illustratively provided here, but the invention provides for additional implementations deriving from, or alternative to, these as one skilled in the art, business, and marketing appreciates. The principles of the invention create a rich environment for instrument, user, feature, music, and market. In this sense the principles of the invention when properly applied and marketed could provide market-opening potential comparable to the introduction of the MIDI protocol.

While the invention has been described in detail with reference to disclosed embodiments, various modifications within the scope of the invention will be apparent to those of ordinary skill in this technological field. It is to be appreciated that features described with respect to one embodiment typically may be applied to other embodiments. Therefore, the invention properly is to be construed with reference to the claims.

I claim:

1. A customizable electronic musical instrument comprising:

a staircase mounting frame comprising:

a plurality of mounting openings, the mounting frame for securing a plurality of electronic musical modules in a staircase configuration, wherein the plurality of electrical musical modules comprises at least two keyboards in the staircase configuration, wherein each of the electronic musical modules is interchangeably secured in one of the plurality of mounting openings of the staircase mounting frame;

wherein the plurality of electronic musical modules at least includes:

a first type of electronic musical module for generating one or more real-time control signals responsive to user operation, a second type of electronic musical module for generating audio signals in response to at least one of the one or more real-time control signals, a third type of electronic musical module for processing the audio signals to generate electrical signals, and an arrangement for attaching a strap, the strap enabling the customizable electronic musical instrument to be worn by a user; and at least one instrument interface adapted to transmit the electrical signals from the third type of electronic musical module to an external system.

2. The electronic musical instrument according to claim 1, wherein the first type of electronic musical module comprises a touchpad.

3. The electronic musical instrument according to claim 1, wherein the first type of electronic musical module comprises a strumpad.

4. The electronic musical instrument according to claim 1, wherein the first type of electronic musical module comprises an impact sensor.

5. The electronic musical instrument according to claim 1, wherein the first type of electronic musical module comprises a slider control.

6. The electronic musical instrument according to claim 1, wherein the first type of electronic musical module comprises an expression wheel.

7. The electronic musical instrument according to claim 1, wherein the first type of electronic musical module comprises a joystick.

8. The electronic musical instrument according to claim 1, wherein the first type of electronic musical module comprises a ribbon controller.

9. The electronic musical instrument according to claim 1, wherein the first type of electronic musical module comprises a button.

10. The electronic musical instrument according to claim 1, wherein the first type of electronic musical module comprises a switch.

11. The electronic musical instrument according to claim 1, wherein the first type of electronic musical module comprises a pressure sensor.

12. The electronic musical instrument according to claim 1, wherein the first type of electronic musical module comprises a multiple-position selector.

13. The electronic musical instrument according to claim 1, wherein the first type of electronic musical module comprises a knob potentiometer.

14. The electronic musical instrument according to claim 1, wherein the second type of electronic musical module for generating audio signals comprises a music synthesizer.

15. The electronic musical instrument according to claim 1, further comprising a switch for routing the one or more real-time control signals.

16. The electronic musical instrument according to claim 1, further comprising a switch for routing the audio signals.

17. The electronic musical instrument according to claim 1, further comprising a bus for routing the audio signals.

18. The electronic musical instrument according to claim 1, wherein the mounting frame further comprises electrical power distribution.

19. The electronic musical instrument according to claim 1, further comprising an audio power amplifier and at least one speaker.

20. The electronic musical instrument according to claim 1, wherein the third type of electronic musical module processes the audio signals to generate electrical signals in response to at least one of the one or more control signals.

* * * * *